US012342905B2

(12) United States Patent
Mittal

(10) Patent No.: US 12,342,905 B2
(45) Date of Patent: Jul. 1, 2025

(54) EXPANDABLE SHOE CAPABLE TO GROW WITH A WEARER/USER'S FEET FOR MORE THAN THREE SIZES

(71) Applicant: Satyajit Mittal, Maharashtra (IN)

(72) Inventor: Satyajit Mittal, Maharashtra (IN)

(73) Assignee: SANOSYZO PRIVATE LIMITED, Pune Maharashtra (IN)

( * ) Notice: Subject to any disclaimer, the term of this patent is extended or adjusted under 35 U.S.C. 154(b) by 119 days.

(21) Appl. No.: 17/925,676

(22) PCT Filed: May 18, 2021

(86) PCT No.: PCT/IB2021/054250
§ 371 (c)(1),
(2) Date: Nov. 16, 2022

(87) PCT Pub. No.: WO2021/234557
PCT Pub. Date: Nov. 25, 2021

(65) Prior Publication Data

US 2023/0276893 A1 Sep. 7, 2023

(30) Foreign Application Priority Data

May 18, 2020 (IN) ..... 202021020899

(51) Int. Cl.
*A43B 3/26* (2006.01)
*A43B 1/04* (2022.01)
(Continued)

(52) U.S. Cl.
CPC ..... *A43B 3/26* (2013.01); *A43B 1/04* (2013.01); *A43B 3/0073* (2013.01); *A43B 3/30* (2013.01); *A43B 9/04* (2013.01); *A43B 13/141* (2013.01)

(58) Field of Classification Search
CPC ..... A43B 13/14; A43B 13/141; A43B 9/04; A43B 9/06; A43B 3/26; A43B 1/04; A43B 3/0073; A43B 3/24; A43B 3/246
(Continued)

(56) References Cited

U.S. PATENT DOCUMENTS 2,147,197 A * 2/1939 Glidden ..... A43B 1/04 36/3 R
3,748,756 A * 7/1973 White ..... A43B 5/00 36/97

(Continued)

OTHER PUBLICATIONS

PCT ISR dated Sep. 16, 2021 (3 pages) & Written Opinion (8 pages).
Indian Examination Report dated Aug. 2, 2022 (6 pages).

*Primary Examiner* — Marie D Bays
(74) *Attorney, Agent, or Firm* — Lippes Mathias LLP

(57) ABSTRACT

An expandable shoe (01) capable to grow with a wearer/user's feet comprising: an upper (18) together with an expanding sole (16) which are capable of automatically adjusting and adapting comfortably to a wearer's feet resulting in increased comfort, usability and postponed obsolescence; wherein the sole (16) having a plurality of flaps (14) growing upwards from the bottom surface of the sole (16) around the sole's (16) circumference; wherein the shoe (01) provided with adjustment mechanisms including plurality of cuts being positioned at different locations in the sole (16) having some and/or equal and/or more distance between the flaps (14) and wherein said cuts effectively vary length and width of the shoe (01) and vary interior size of the shoe (01) to provide a comfortable fit to a wearer/user.

16 Claims, 27 Drawing Sheets

(51) Int. Cl.

| | |
|---|---|
| ***A43B 3/00*** | (2022.01) |
| ***A43B 3/30*** | (2006.01) |
| ***A43B 9/04*** | (2006.01) |
| ***A43B 13/14*** | (2006.01) |

(58) Field of Classification Search
USPC ..... 36/9 R, 11, 97, 102
See application file for complete search history.

(56) References Cited

U.S. PATENT DOCUMENTS

| | | | | |
|---|---|---|---|---|
| 5,765,296 | A | 6/1998 | Ludemann et al. | |
| 2004/0128861 | A1 | 7/2004 | Durand | |
| 2004/0148804 | A1* | 8/2004 | Romano | A43B 3/00 36/97 |
| 2005/0115113 | A1 | 6/2005 | Miller et al. | |
| 2007/0011910 | A1* | 1/2007 | Keen | A43B 23/07 36/50.1 |
| 2010/0223818 | A1* | 9/2010 | Hampton | A43B 3/0078 36/7.1 R |
| 2013/0000159 | A1 | 1/2013 | Hatfield et al. | |
| 2014/0013624 | A1* | 1/2014 | Stockbridge | A43B 13/181 36/103 |
| 2014/0250723 | A1* | 9/2014 | Kohatsu | A43B 13/141 36/28 |
| 2015/0173456 | A1* | 6/2015 | Rushbrook | A43B 13/181 36/25 R |
| 2016/0353837 | A1 | 12/2016 | Lyden | |
| 2017/0042284 | A1* | 2/2017 | Lawless | A43B 13/14 |
| 2017/0042285 | A1* | 2/2017 | Lawless | A43B 13/187 |
| 2017/0245582 | A1* | 8/2017 | Green | A43B 1/04 |
| 2017/0280823 | A1* | 10/2017 | Langvin | A43B 9/12 |
| 2017/0360141 | A1* | 12/2017 | Azoulay | A43B 11/00 |
| 2017/0367439 | A1* | 12/2017 | Fallon | A43B 13/04 |
| 2018/0020766 | A1* | 1/2018 | Edwards | A43B 13/141 36/97 |
| 2018/0317592 | A1* | 11/2018 | Rudolf | A43B 1/04 |
| 2018/0368509 | A1* | 12/2018 | Cook | A43B 7/141 |
| 2019/0075885 | A1 | 3/2019 | Langvin et al. | |
| 2019/0142110 | A1* | 5/2019 | Cruz | A43B 3/16 36/15 |
| 2019/0365048 | A1* | 12/2019 | Fontaine | A43B 23/027 |
| 2020/0205515 | A1* | 7/2020 | Cross | A43B 13/28 |
| 2020/0288815 | A1* | 9/2020 | Wang | A43B 23/0255 |
| 2020/0305544 | A1* | 10/2020 | Cross | A43B 9/00 |
| 2020/0405005 | A1* | 12/2020 | Chang | A43B 23/0255 |
| 2021/0052034 | A1* | 2/2021 | Cass | A43B 13/125 |

* cited by examiner

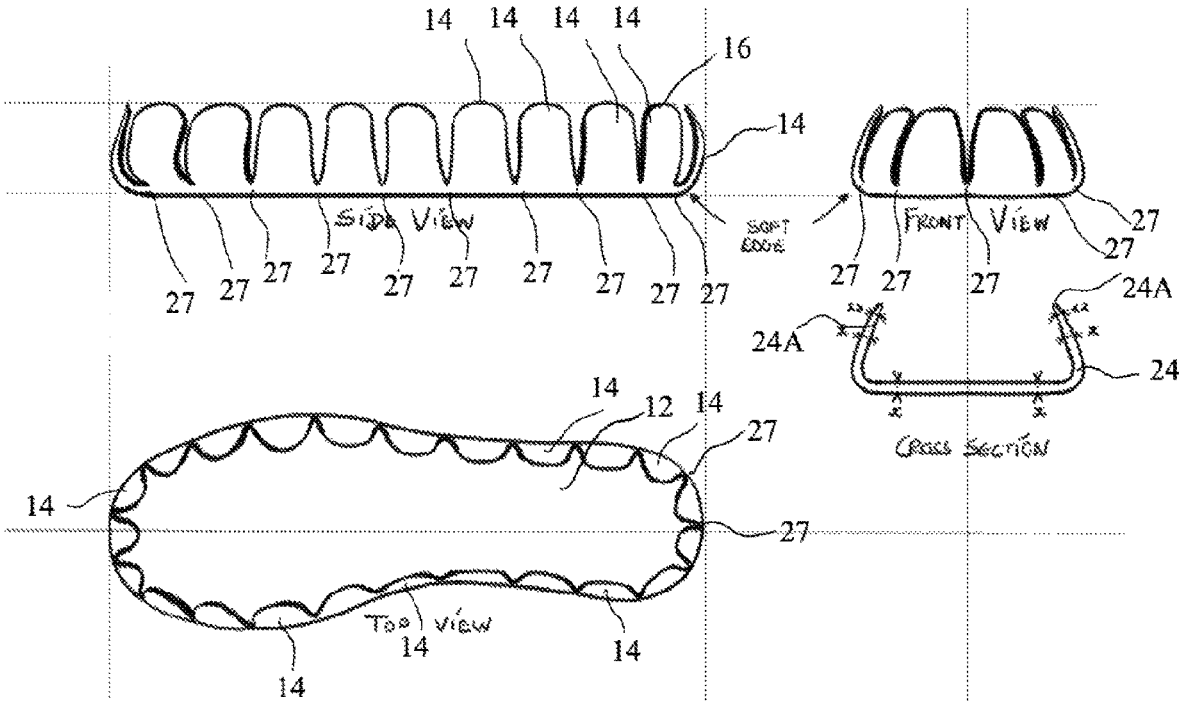
Figs. 4A-D
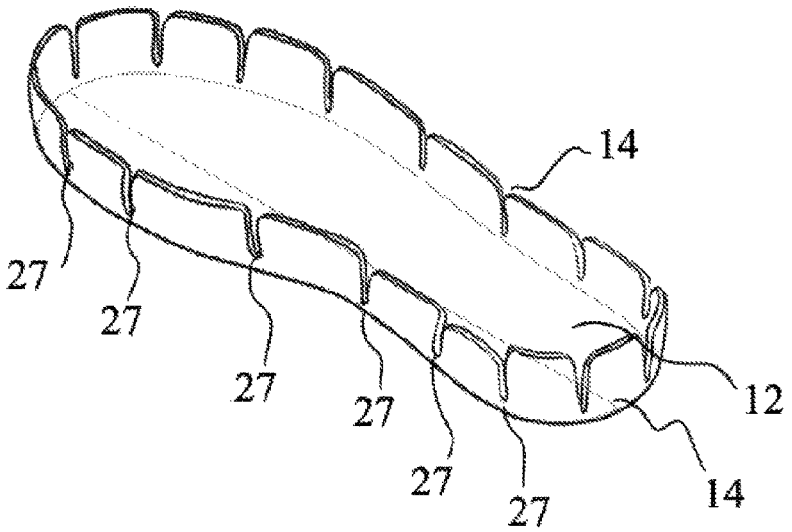
Fig. 4E

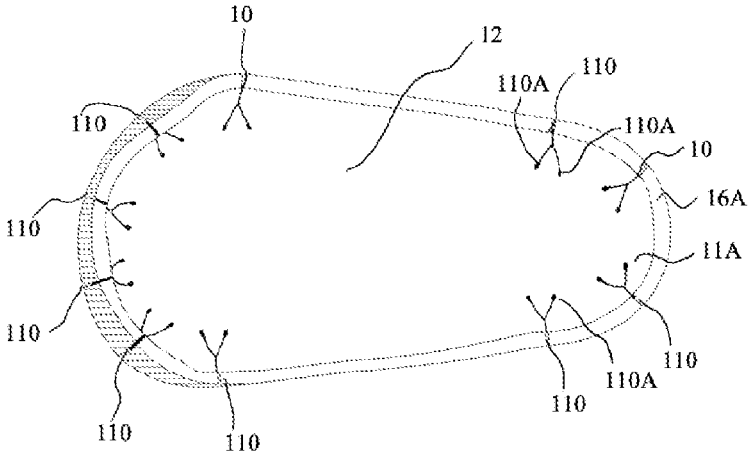
Fig. 6L(i)
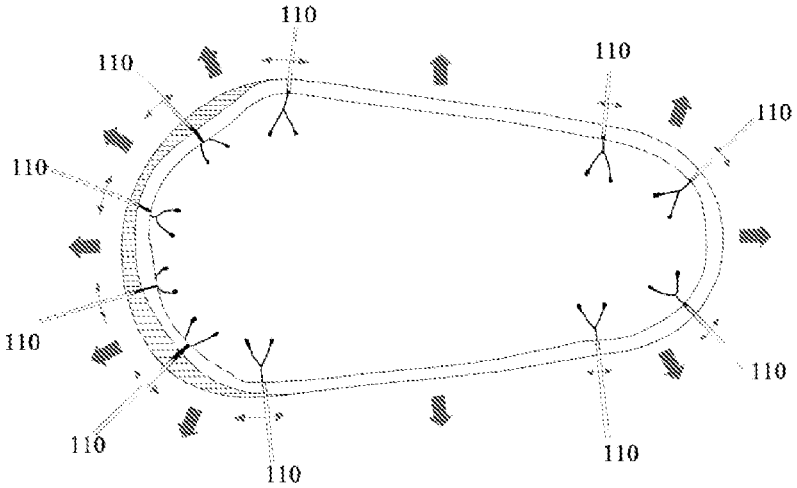
Fig. 6L(ii)
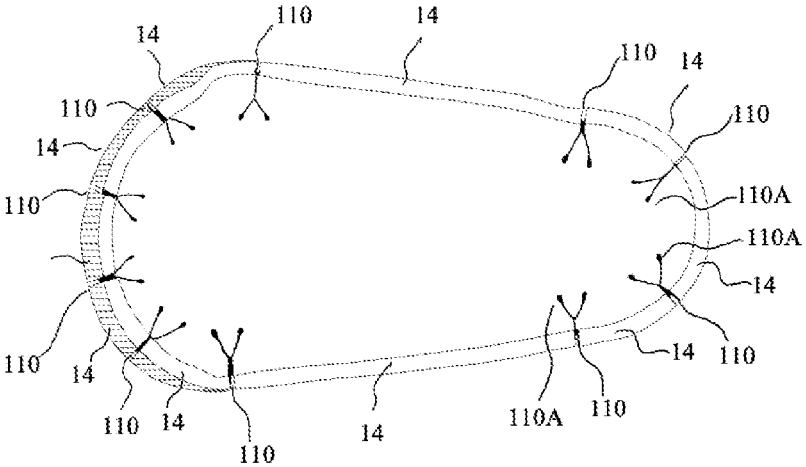
Fig. 6M(i)

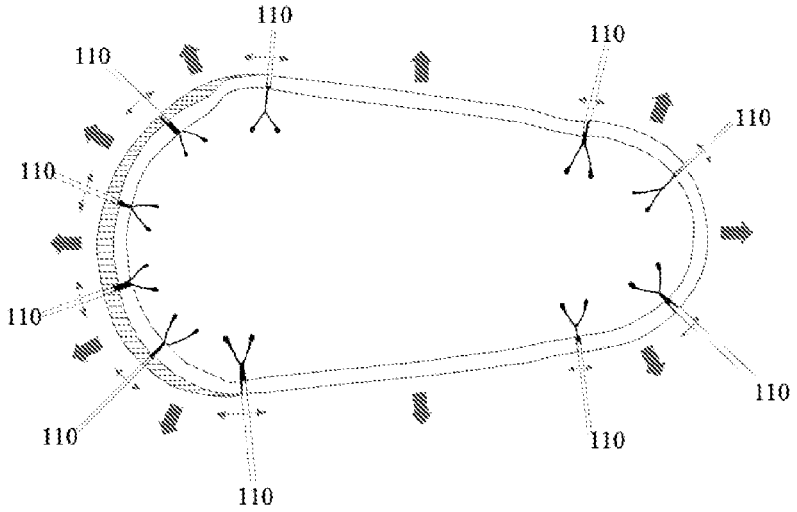
Fig. 6M(ii)
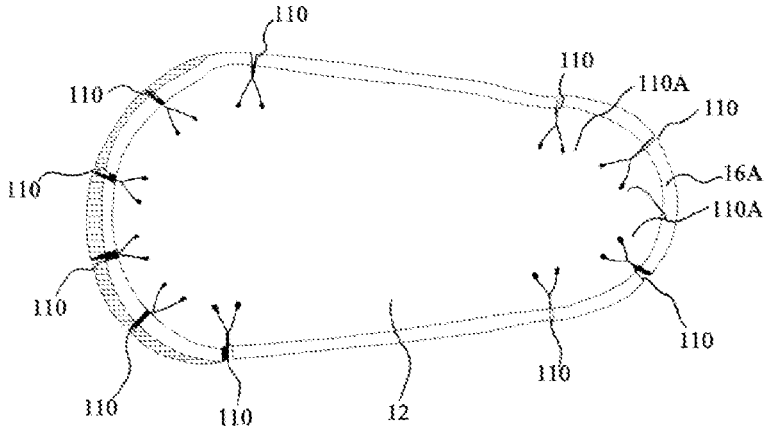
Fig. 6N(i)
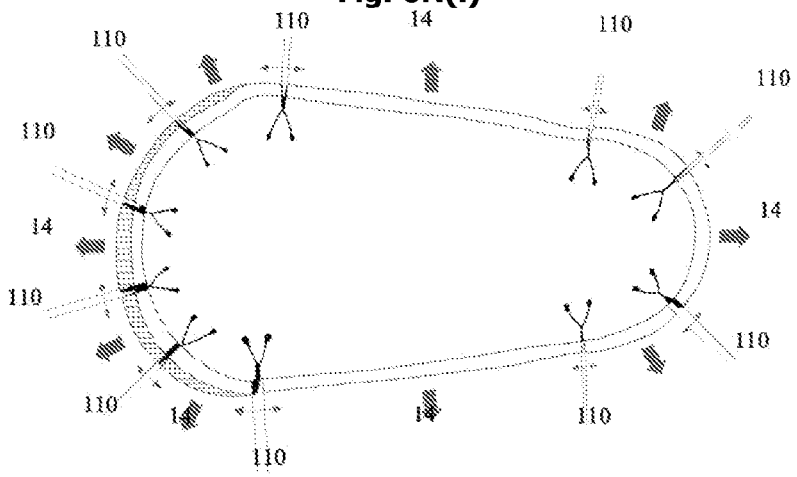
Fig. 6N(ii)

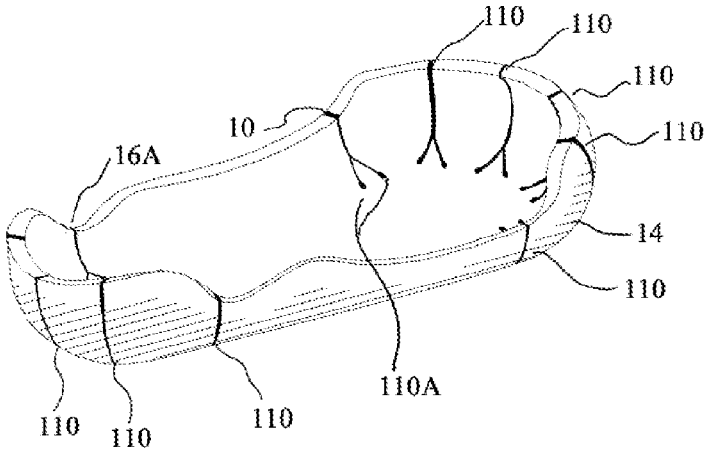
Fig. 6-O(i)
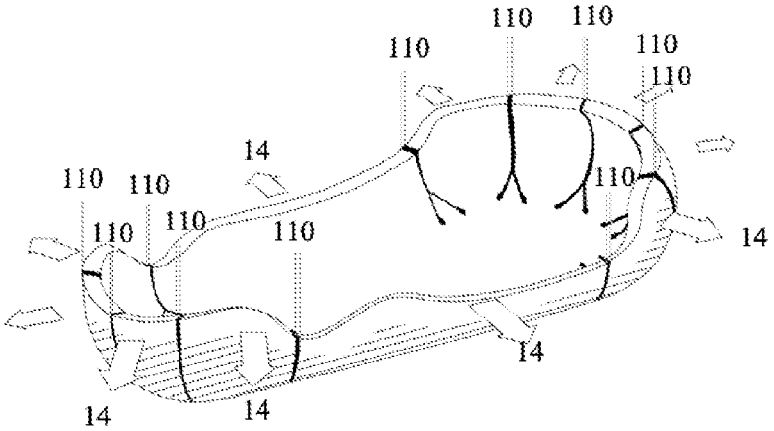
Fig. 6-O(ii)
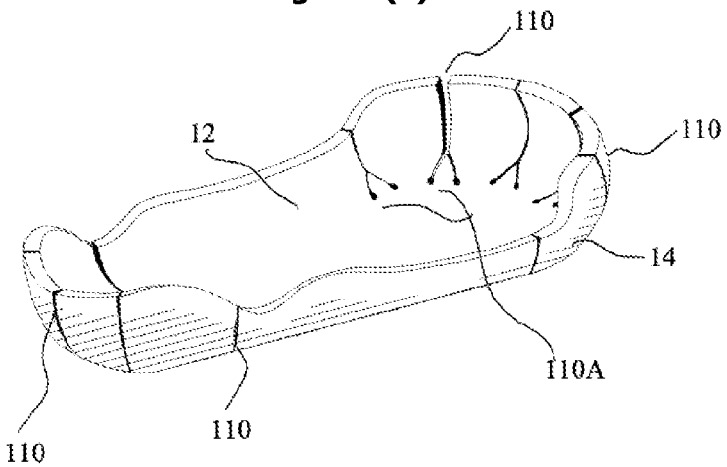
Fig. 6P(i)

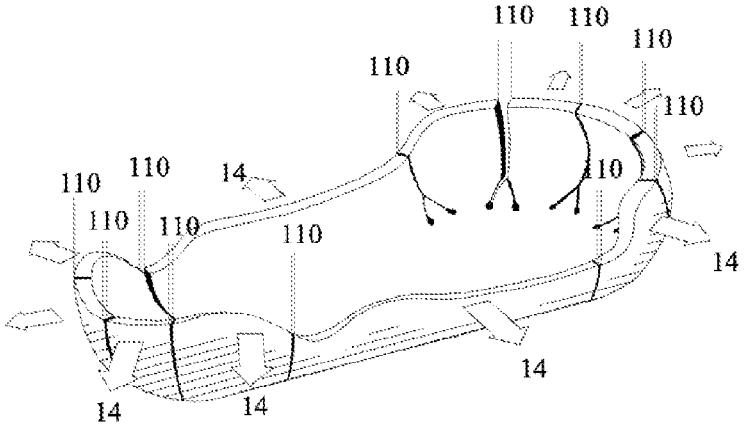
Fig. 6P(ii)
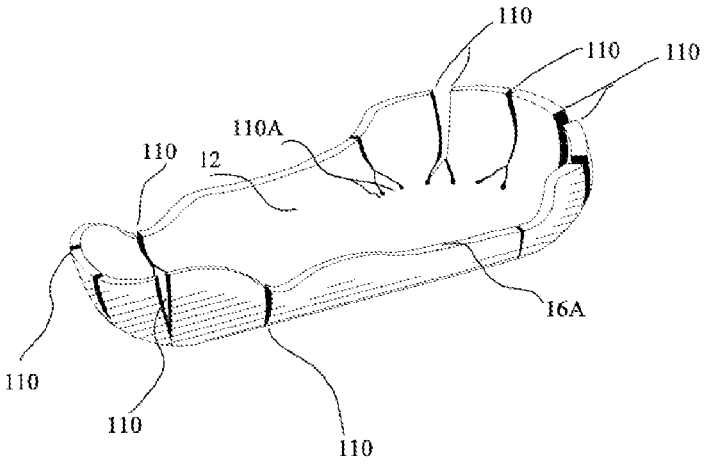
Fig. 6Q(i)
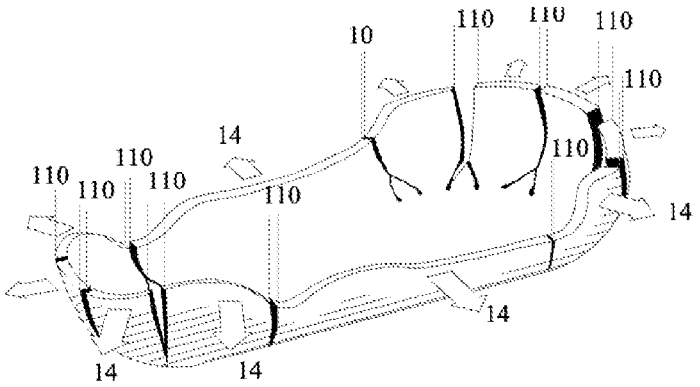
Fig. 6Q(ii)

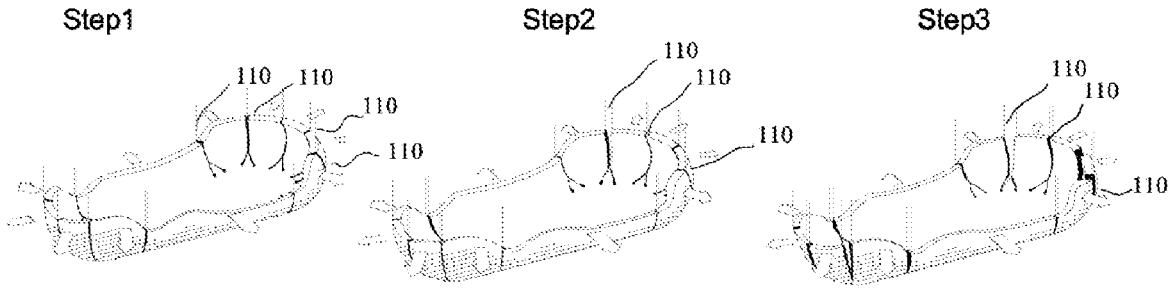
Figs. 6R (i) (ii) (iii)
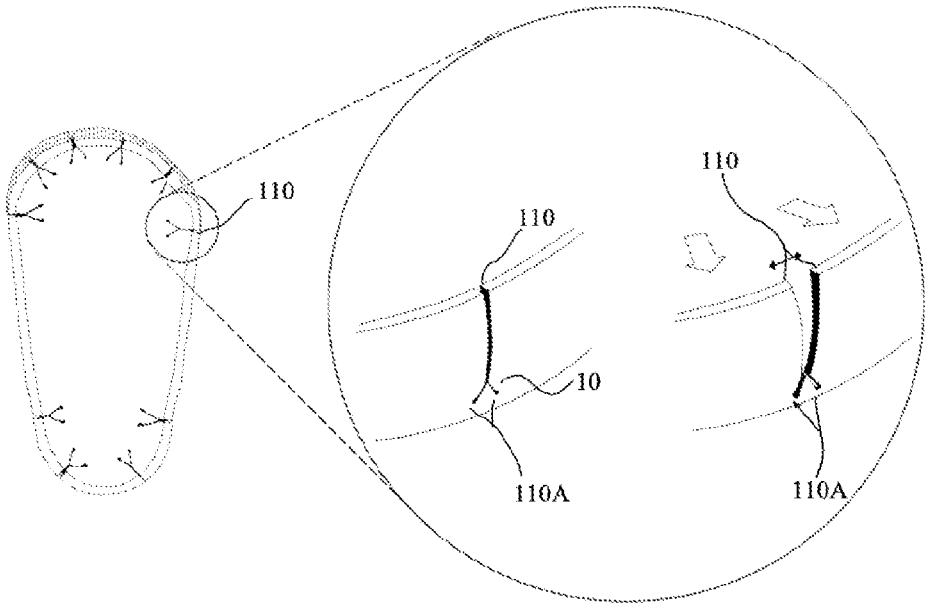
Fig. 7A
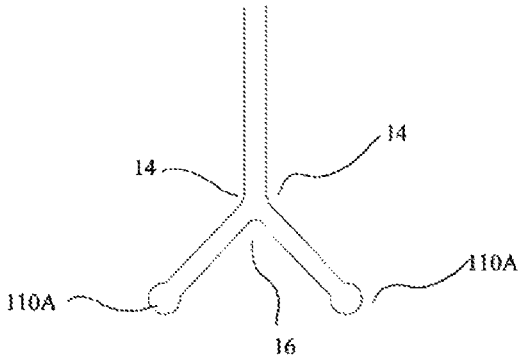
Fig. 7B

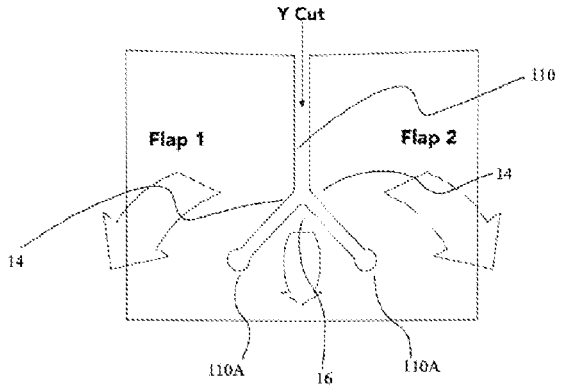
Fig. 8A
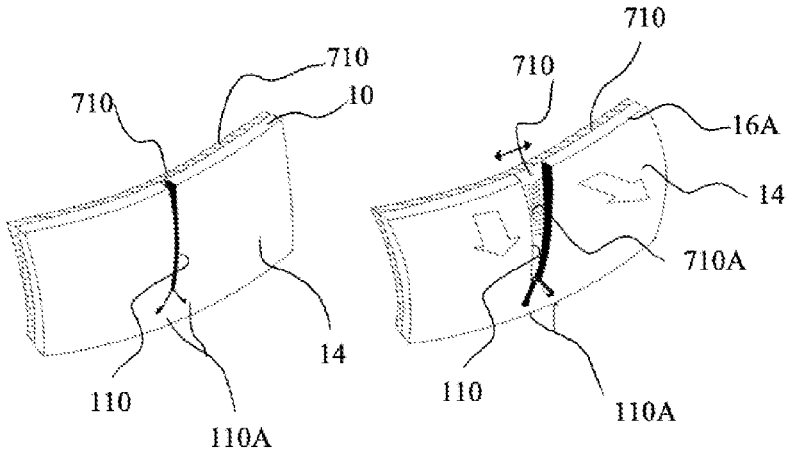
Fig. 8B
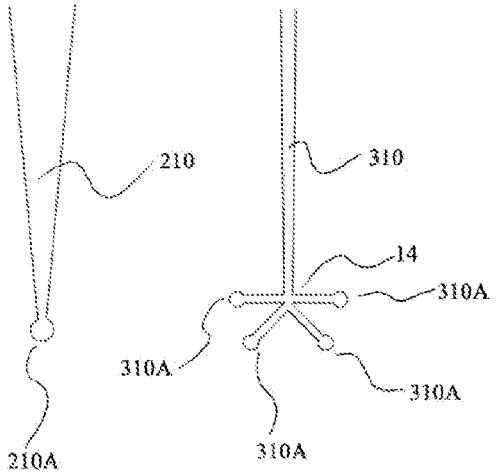
Fig. 9.1

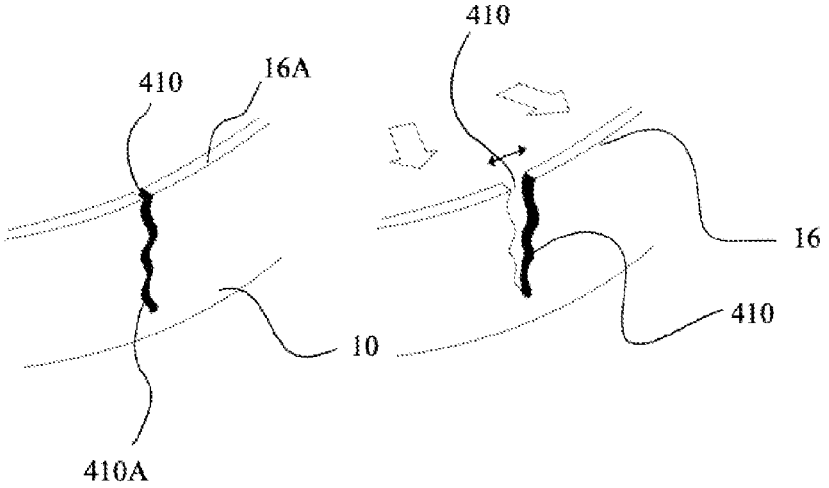
Fig. 9.2
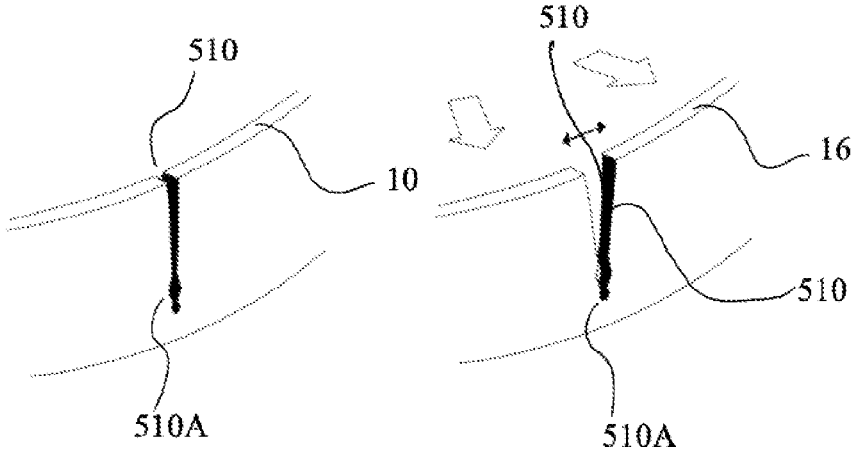
Fig. 9.3
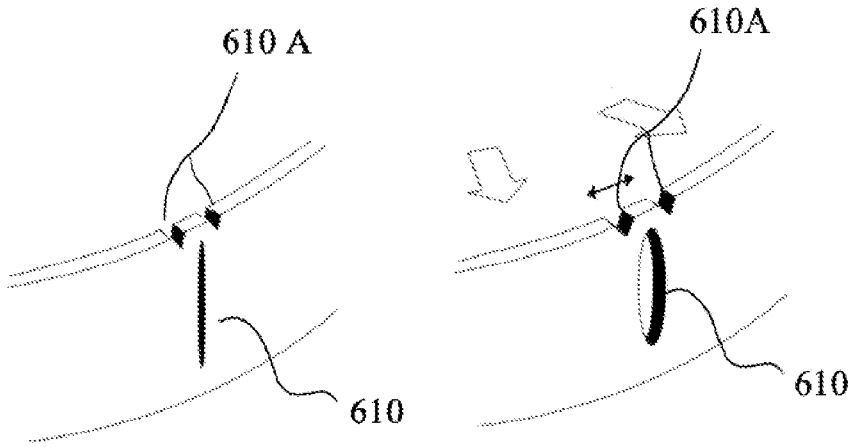
Fig. 9.4

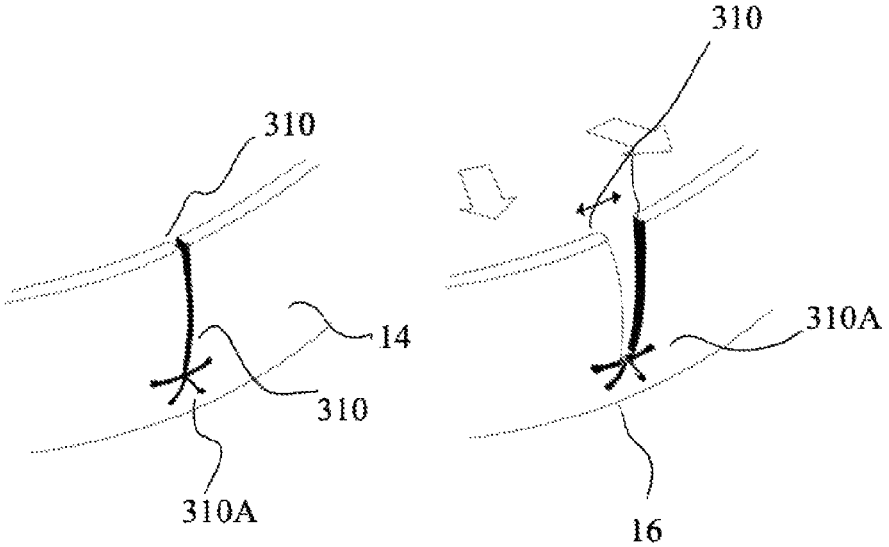
Fig. 9.5
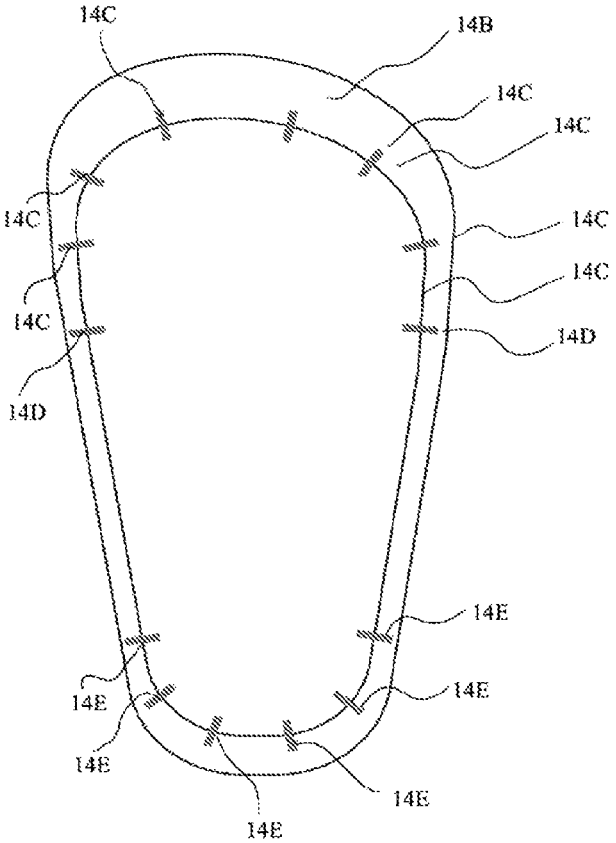
Fig. 10

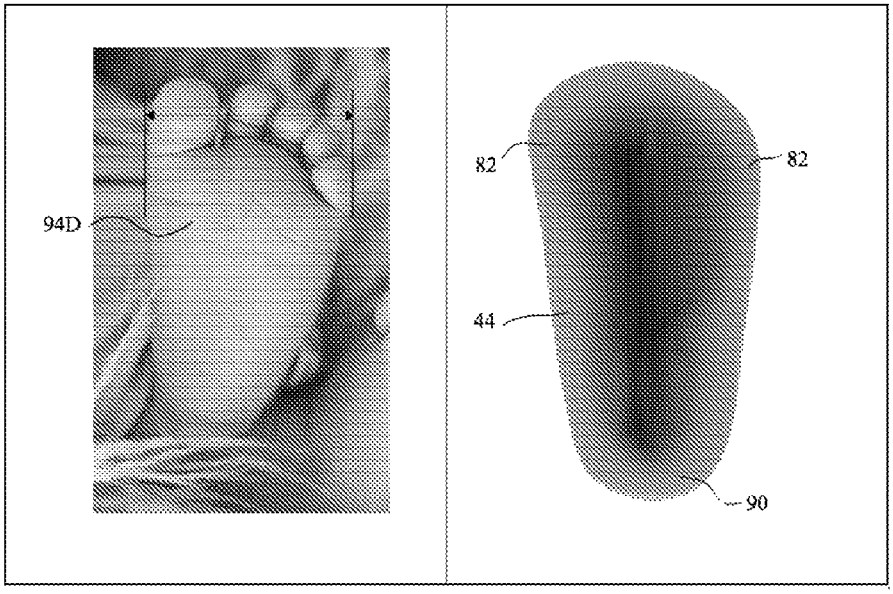
Fig. 13 (A) & (B)
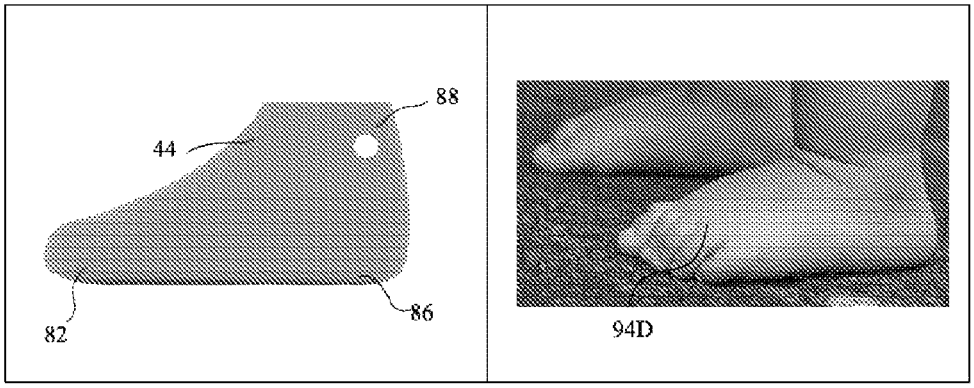
Fig. 13 (C) & (D)
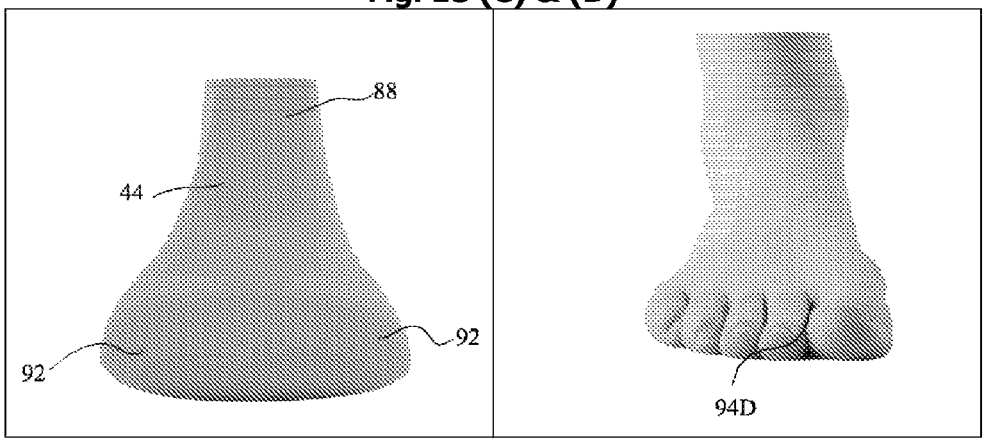
Fig. 13 (E) & (F)

EXPANDABLE SHOE CAPABLE TO GROW WITH A WEARER/USER'S FEET FOR MORE THAN THREE SIZES

This application is a National Stage Entry of International Application No. PCT/IB2021/054250, filed May 18 2021, which claims priority to Indian Application No. 202021020899, filed May 18, 2020, the contents of which are incorporated by reference herein.

FIELD OF THE INVENTION

The invention relates to shoes in general. In particularly, the present invention relates to shoes for use by humans, for example children. More particularly, the present invention relates to an improved expandable shoe capable to grow with a human's feet for at least more than three sizes and methods related thereto. A single pair of shoes organically expands over multiple sizes providing increased usability and product life.

BACKGROUND OF THE INVENTION

Every person's feet are differently shaped. Conventional shoes are made considering an average sizing, and are intended to fit all and any user in a specific size. This makes the fitting generalised and common, to accommodate most feet shapes in that size.

Shoes are made in many sizes, for men, women and children. With the growth in age of every individual the feet sizes change and vary upto a certain age. The commercially available ready-to-wear shoes are made in varying sizes to cater to such varying sizes. These sizes vary from sizes 3.5 to 15 for men, sizes 5 to 13.5 for women and sizes 5 to 13 for children. Some conventional shoes also come in half and quarter sizes, for example, size 9, 9.5, 10 for better fitting.

It does not provide a custom and perfect fit. New pairs of conventional shoes are meant to be broken in, or given time for the user's feet to adapt and adjust according to them.

In order to find a reasonable semblance of custom-fit for the customers, shoe manufacturers make all shoes in all of the above sizes. This increases inventory, manufacturing overheads and also creates more shoes, which ultimately end up in landfills, and become harmful for the environment apart from increase cost/price to manufacturers and end consumers.

Even with such a wide variety of sizes of available shoes, often a wearer fails to find a perfect fit shoe. This is due to the fact that not only the length of their feet but also the width will determine how well they tolerate the shoes.

In the case of children, the growth in size of their feet with their overall growth often makes the parents' task of finding a perfect fit shoe difficult and daunting.

As a result, this necessitates frequent replacement with larger and larger size shoes.

Further, existing shoes may/may not have stretchy elastic with or without fasteners such as laces, straps, belts, zippers amongst other similar components to account for slightly oversized feet in shoes. Such fasteners only brace/allow room by loosening in one area. They do not grow or tighten organically and equally in all areas. Conventional shoes do not cater to change in sizes. When shoes are outgrown by feet, they simply need to be replaced. Essentially, each shoe size of feet requires a pair of shoes matching in size with existing footwear technology. This gives very short usage life to these conventional shoes and makes them useless to the user after they have outgrown them.

Shoe not being appropriately fit may lead to impact on sensory nerves and hamper the growth specially among children. Further more in case of children, the number of pairs required from age 1 to 12 are approximately 15/16 pairs and in order to avoid repetitive frequent purchase, parents tend to buy larger size so that it lasts or is worn for a longer period of time than intended which has impact in terms of discomfort, causing supination and pronation of the foot. This may lead to a life long disorder.

Moreover, many parents across the globe are not able to keep up with this frequent purchase of shoes for children. This leads to three possibilities such as "hand me down" old shoes from older siblings/relatives, make shift footwear from scrap or no shoes at all. In all of the above cases, specially incase of no footwear, the child's feet is exposed to soil contamination which lead to worms in the child's stomach causing various associated illnesses and malnutrition. It also leaves them prone to cuts in the feet caused by being exposed to sharp objects in the soil.

To counter the above problems, the conventional shoes need to be 'broken in', and the user's foot adapts to their shape and fitting. However, this may also damage the user's natural foot shape, and cause foot problems such as hammertoes, calluses, bunions and other related foot deformities.

Some of the existing sandals with adjustable straps claim to grow 5 sizes. Such sandals need manual adjustment for 5 sizes and the expansion in them is not organic or as fine tuned to provide a comfort fit. Such sandals have adjustable straps in three areas of the foot, sides, at the front and at the back of the heel. Yet, this adjusted growth is not organic and automatic when compared to the present invention. Furthermore, being sandals, they do not provide good, all round foot protection due to the existence of gaps and cutouts in them. This also leads to exposure to soil and other elements which can have adverse effects on the user's feet as well as overall health.

The present invention addresses all of the above issues adequately wherein while conventional shoes follow "Foot adapts shoe", the present invention works on "Shoe adapts foot". The shoe of the present invention expand sufficiently to accommodate a multiple range of feet sizes wherein it is anticipated that a few sizes of shoes will be necessary for all age groups and both genders.

The shoe of the present invention expands organically, which means every user having unique feet from others will have a shoe adjusting comfortably to their feet. The shoe of the present invention is provided with elastic upper together with an expanding sole which are capable of automatically adjusting and adapting comfortably to the wearer's feet. Thus, the expansion is automatic and does not need any manual operation to accommodate grown sizes of feet.

SUMMARY AND OBJECTS OF THE INVENTION

The present invention relates to an improved expandable and adjustable shoe capable of growing a human's i.e. a wearer's feet for multiple varying sizes, in particular for at least more than three sizes. The concept allows the shoe to have the ability to be expanded as a wearer's foot grows so that a single shoe can be used for three times the life of conventional shoes. Thus, a single pair of shoes organically expands over multiple sizes providing increased usability and product life.

The present invention, thus, provides a shoe which expands and adapts according to each and every person's feet and its growth. It allows a custom fitting and bespoke experience to every user as it adapts and adjusts to fit every user, ultimately providing maximum comfort to feet. The expandable shoe saves money on purchasing new shoes every few months. With the expandable shoe, a user gets three to five pairs of shoes for the price of one.

Thus, one aspect of the present invention relates to an expandable shoe capable to grow with a wearer/user's feet comprising: an upper together with an expanding sole which are capable of automatically adjusting and adapting comfortably to a wearer's feet resulting in increased comfort, usability and postponed obsolescence; wherein the sole having a plurality of flaps growing upwards from the bottom surface of the sole around the sole's (16) circumference; wherein the shoe provided with adjustment mechanisms including plurality of cuts being positioned at different locations in the sole having some and/or equal and/or more distance between the flaps and wherein said cuts effectively vary length and width of the shoe and vary interior size of the shoe to provide a comfortable fit to the wearer/user.

The upper comprises: a stretchable collar with omni expansion feature(s) and having a collar tongue, an upper top line, a stretchable upper vamp being inseparably stitched/connected to the stretchable collar, a stretchable lower vamp being inseparably stitched/connected to the stretchable upper vamp, a stretchable thick stiff knit pattern being inseparably stitched/connected to the stretchable lower vamp wherein the stretchable thick stiff knit pattern in turn being inseparably stitched/connected to a lateral and base stability for foot; wherein the stretchable lower vamp provided with plurality of breathable ventilation holes which helps the foot to perspire when the user is wearing the expandable shoe and wherein a pullstrap is inseparably attached to the upper on back side of the shoe.

The upper is made of stretchy, mesh, elastic knitted material which is stuck inside the sole being inseparable with the flaps encompassing the upper.

The sole having a sole topline configured to run through the entire upper periphery of the sole having equal width in that the sole topline runs at varying depth on left and right sides of the sole in comparison to the front and back of the sole and wherein the sole topline having a larger height on front and back of the sole in comparison to the height on the left and right sides of the sole. The sole having uniform thickness with a tapered end towards the topline of the sole. The sole is further provided with structural strengtheners in the form of ribs on an inner and an outer side of the sole.

The sole is also provided with an elastomer layer/stretchable elastic midsole in midsole section thereof being pasted or sandwiched in between an inner lining of the sole and the upper.

The cuts provided in the flaps of the sole are an inverted 'Y' shaped cuts with rounded vertices in that the rounded vertices shaped like a circle to avoid tears and snags of flaps.

The cuts provided in the flaps of the sole include other alternative shape cuts such as a 'V' shaped cuts with rounded vertices, a straight cut having at least one rounded vertices, a star cut having at least four rounded vertices, a wave cut having at one rounded vertices, a nib cut having at one rounded vertices, at least two micro cuts on the top line of the sole and at least one slit cut on the walls of the sole.

Another aspect of the present invention relates to a last for making the expandable shoe, the last having a rounded profile comprising: a last top; a wide toe box in front thereof adhering to the natural footshape of adults and children; a straight base line with no toe spring and a zero heel raise or drop; no edge filleted last having no sole edge line, wherein the last designed taking reference from human foot anatomy including its contours, cross sections and curves inspired from the human foot.

Yet another aspect of the present invention relates to method(s) of manufacturing related to the expandable shoe.

A primary object and advantage of the present invention is to provide an improved expandable shoe for a human's i.e. a wearer's feet.

Another object and advantage of the present invention is to provide an expandable shoe capable of growing with the wearer's feet for at least more than three sizes.

Another object and advantage of the present invention is to provide a shoe that may be worn easily and comfortably allowing for healthy foot development.

Another object and advantage of the present invention is to provide a shoe which is designed to expand and automatically adjust according to the wearer's foot shape to provide a precise fit as per the wearer's foot growth resulting in increased comfort, usability and postponed obsolescence.

Another object and advantage of the present invention is to provide an expandable shoe including, but not limited to, unisex designs which can be used by any one with adjustment mechanisms which can vary the length of the shoe and vary the interior size of the shoe to provide a comfortable fit.

A further object and advantage of the present invention is to provide an expandable shoe for infants from 0 to 26 months of age and for a child upto 9 years of age with each of the shoes in the pair of shoes having adjustment mechanisms to accommodate growth of the foot and to accommodate differences in the size of the foot in an infant or child.

Another object and advantage of the present invention is to provide an expandable shoe made of flexible but durable materials such as, not being limited to, lyocell, merino wool and other such strong flexible materials for uppers and rubber, bio-TPU and other such durable materials for the sole for enduring the wear and tear from the prolonged usage as well as providing comfort and protection.

Another object and advantage of the present invention is to provide a non-skid sole for the expandable shoe which allows the wearer to feel the ground both indoors and outdoors. The sole has optimum thickness which provides protection for the foot but also allows the wearer to feel the ground thereby activating his/her nerve endings in the foot sole leading to brain development.

Another object and advantage of the present invention is to provide an expandable shoe which addresses and contributes towards the UN Sustainable Development Goals (SDGs) specifically, primary contribution towards: (a) SDG 3—Good health and well being; (b) SDG 12—Responsible production and consumption; (c) SDG 9—Industry, innovation and consumption; and (d) SDG 17—Partnership for the goals.

Yet another object and advantage of the present invention is to provide a shoe which provides expansion for a foot in upward, lengthwise and sideways directions to provide a comfortable fit.

These and other objects of the present invention will become readily apparent upon further review of the following description.

BRIEF DESCRIPTION OF THE ACCOMPANYING DRAWINGS

The invention will be described by way of examples and with reference to the accompanying drawings wherein.

FIG. 4A to D show the orthographic views including top, side, front and cross-sectional views respectively of the sole and its flaps according to one embodiment of the present invention.

FIG. 4E shows a perspective view of the sole and its flaps of FIGS. 4A to D.

Figure 4F:
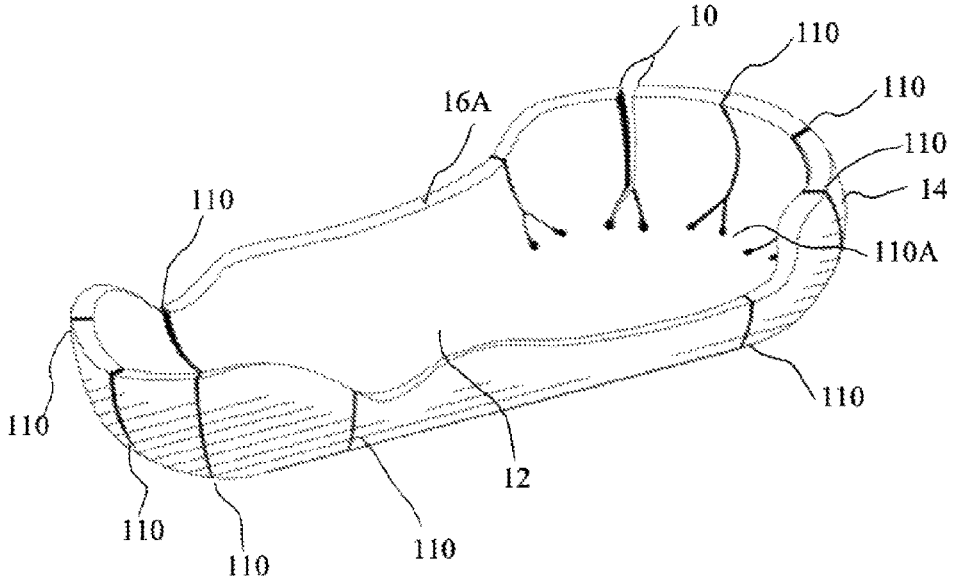

FIG. 4F shows a perspective view of the sole and its flaps according to another embodiment of the present invention.

Figure 5A:
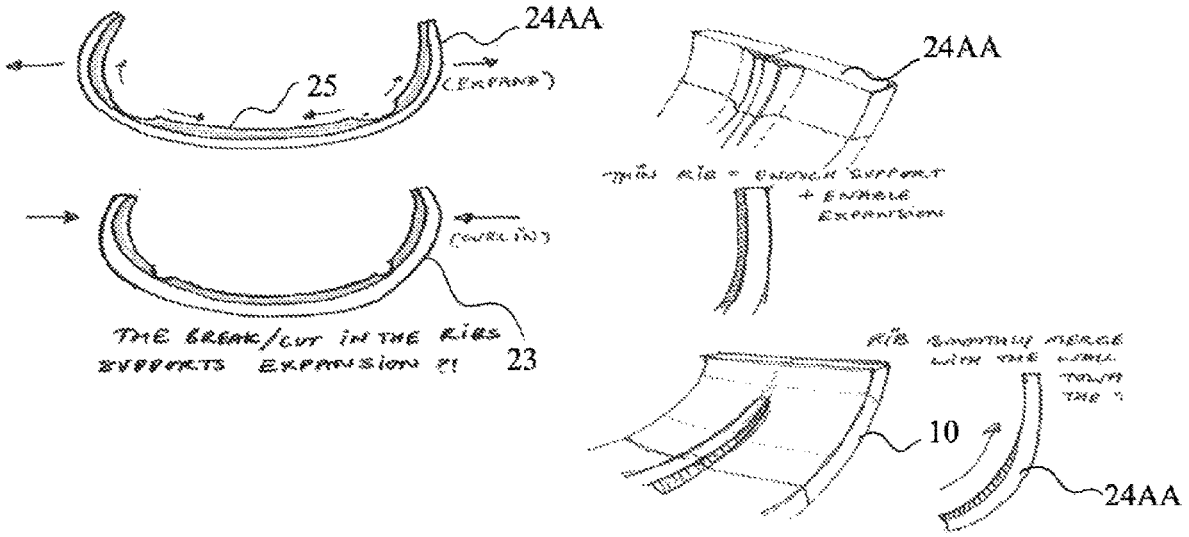
Figure 5B:
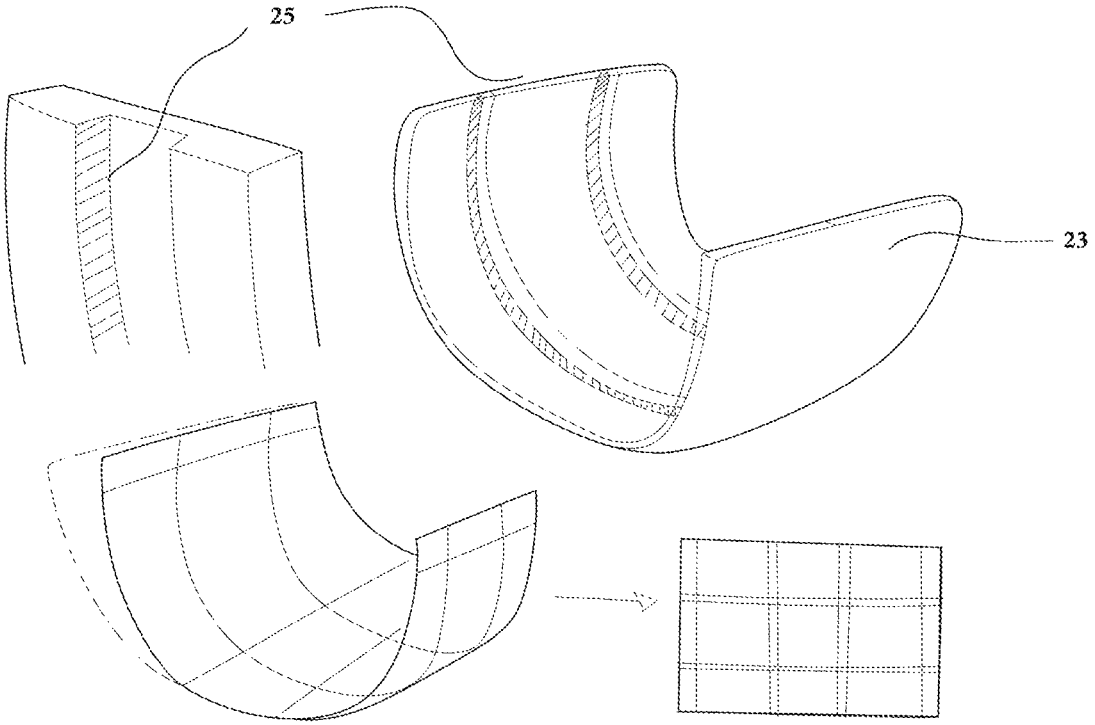

FIGS. 5A and 5B illustrate set of handmade sketches showing structural strengtheners such as ribs on the inner and outer side of the sole according to one of the embodiments of the present invention.

Figure 6:
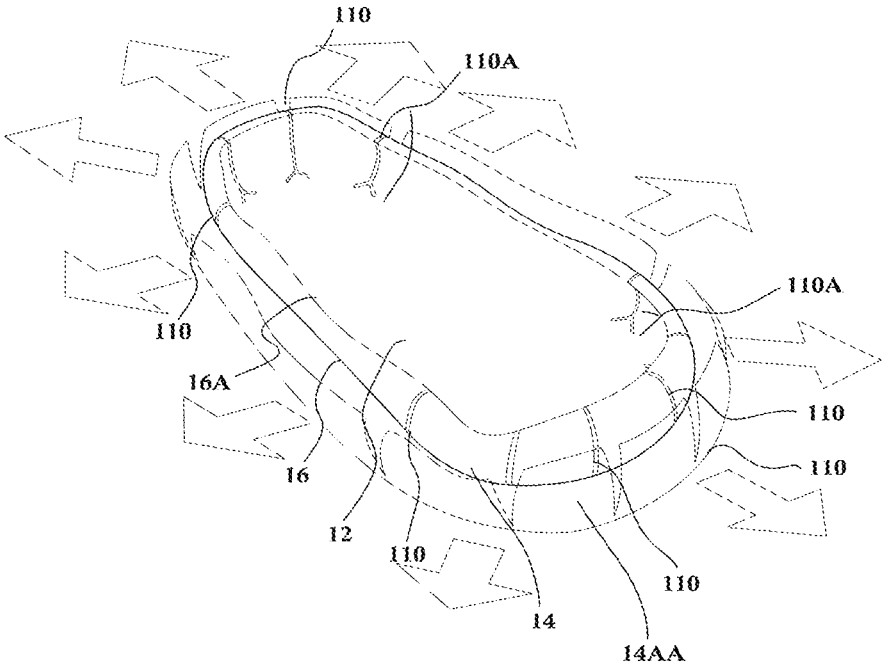

FIG. 6 shows the expansion of the sole due to the opening of the flaps according to the present invention.

Figure 6A:
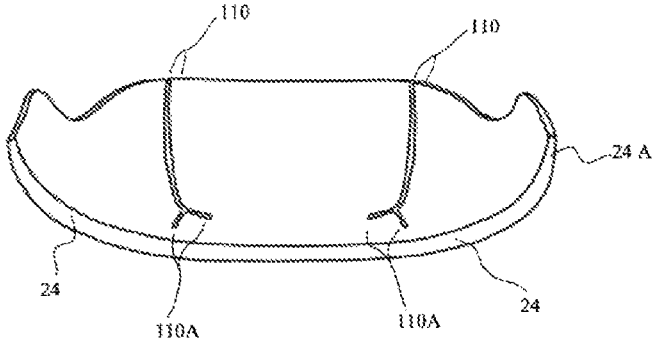

FIG. 6A shows a widthwise cross-section of the sole in an unexpanded state according to one of the embodiments of the present invention.

Figure 6B:
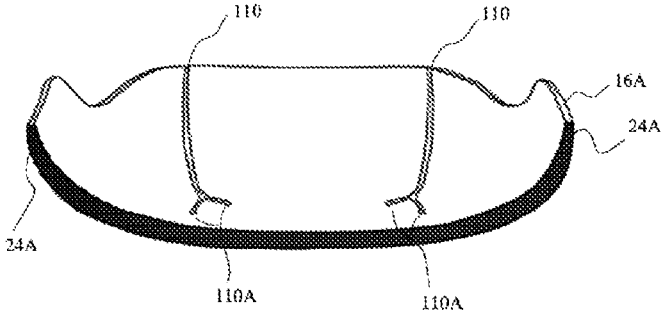

FIG. 6B shows shaded area to indicate a widthwise cross-sectional thickness and profile of the sole as shown in FIG. 6A.

Figure 6C:
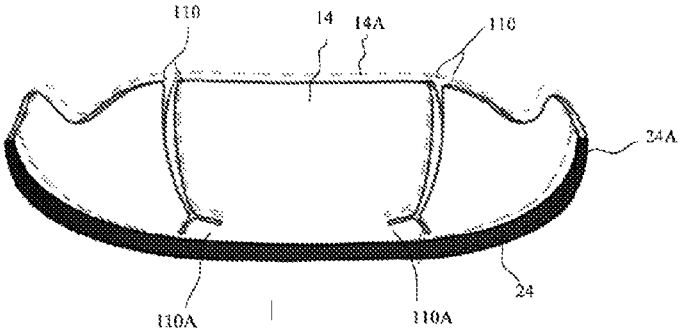
Figure 6D:
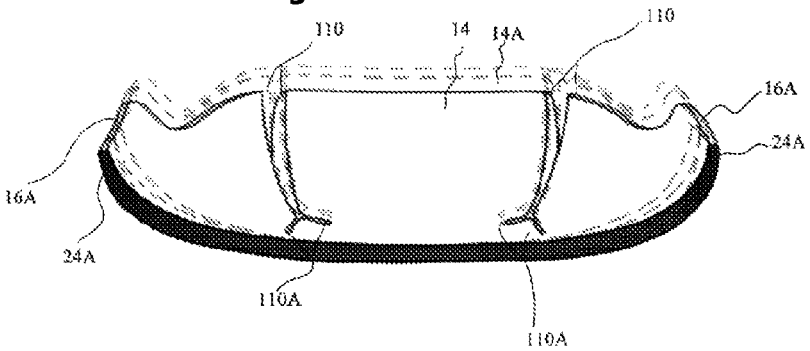

FIGS. 6C and 6D show a widthwise cross-section of the sole being in an expanded state respectively as shown in FIG. 6A.

Figure 6E:
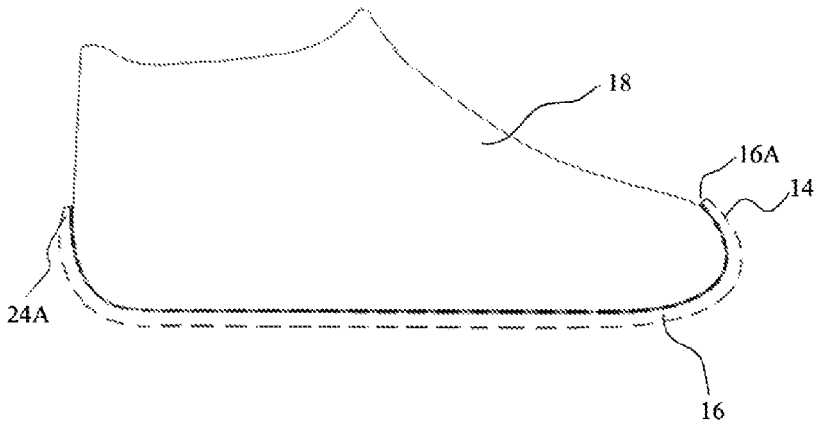
Figure 6F:
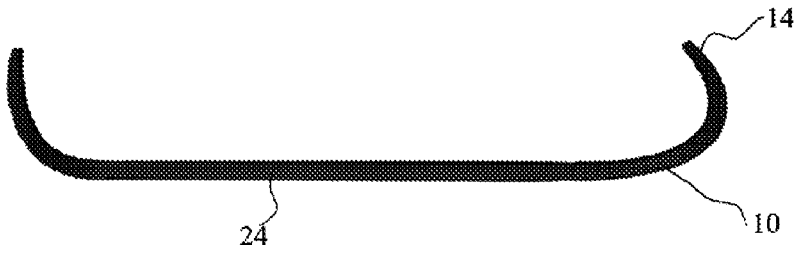

FIGS. 6E and 6F show a lengthwise cross-section and shaded area to indicate a lengthwise cross-sectional thickness and profile respectively of the sole in an unexpanded state according to one of the embodiments of the present invention.

Figure 6G:
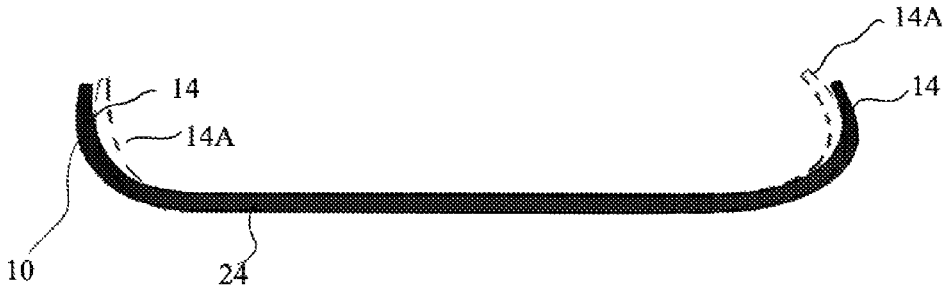
Figure 6H:
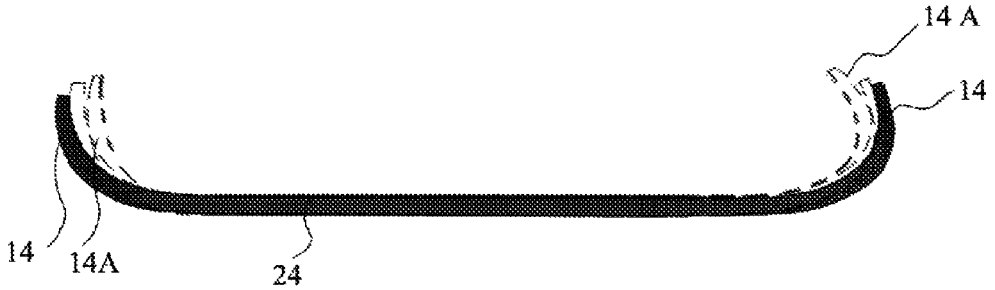

FIGS. 6G and 6H show a lengthwise shaded area to indicate a cross-sectional thickness and profile respectively of the sole as shown in FIG. 6E in an expanded state.

Figure 6I:
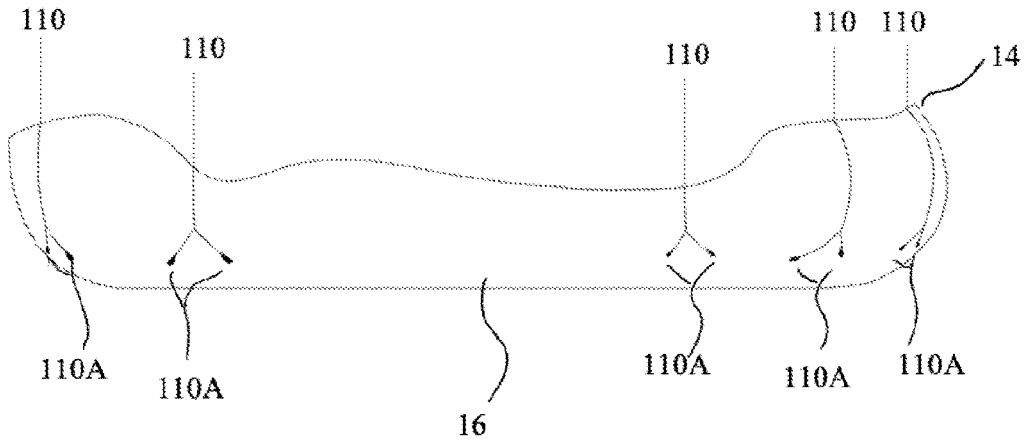
Figure 6J:
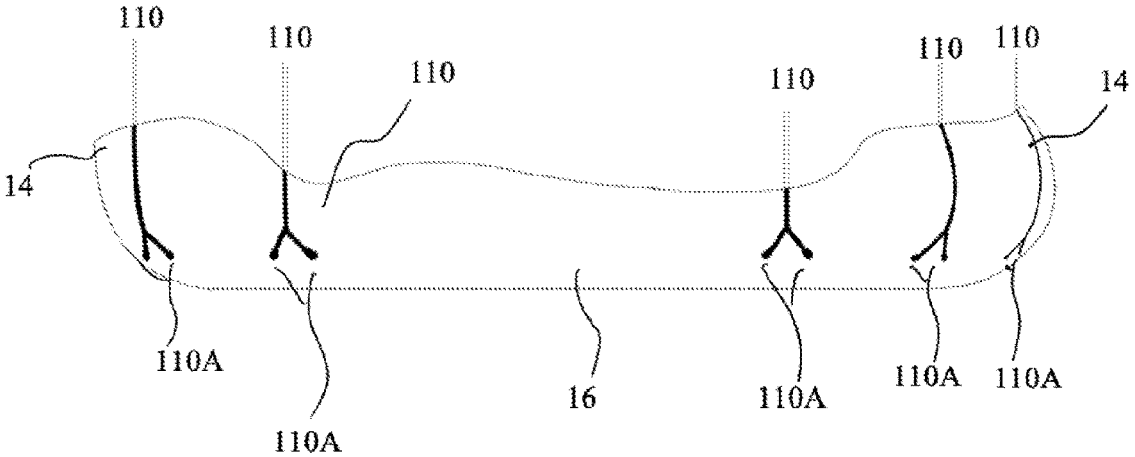
Figure 6K:
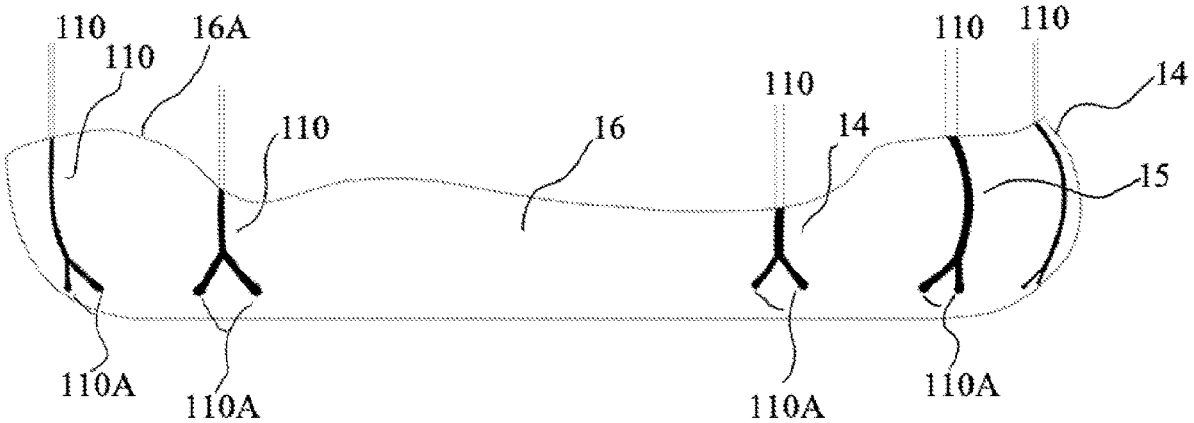

FIGS. 6I to 6K show a side view respectively of the sole in an expanded state as shown in FIG. 6.

FIGS. 6L(i), 6M(i) & 6N(i) show a top view of the sole respectively as shown in FIG. 6 being in a least stage of expansion.

FIGS. 6L(ii), 6M(ii) & 6N(ii) show a top view of the sole respectively as shown in FIG. 6 being in an expanded and gradually growing to most expanded stage of expansion.

FIGS. 6O(i), 6P(i) & 6Q(i) show a perspective view of the sole respectively as shown in FIG. 6 being in a least stage of expansion.

FIGS. 6O(*ii*), 6P(ii) & 6Q(ii) show a perspective view of the sole respectively as shown in FIG. 6 being in an expanded and gradually growing to most expanded stage of expansion.

FIGS. 6R(i), (ii) & (iii) show the comparison of the various stages of the sole respectively as shown in FIG. 6 from the stage of least expanded to the expanded and/or most expanded stage.

FIG. 7A shows the flaps in a top view of the sole which are partitioned with inverted 'Y' shaped cuts and its detail according to one of the embodiments of the present invention.

FIG. 7B shows the inverted 'Y' shaped cut in greater detail of FIG. 7A.

FIG. 8A shows the flaps in the sole which are partitioned with inverted 'Y' shaped cuts in greater detail showing the possibility and direction of expansion indicated by arrows according to the present invention.

FIG. 8B shows the flaps in the sole which are partitioned with inverted 'Y' shaped cuts from the stage of least expanded to the expanded and/or most expanded stage according to the present invention.

FIGS. 9.1 to 9.5 show other and/or various shape(s) cut vertices other than the 'Y' cut from the stage of least expanded to the expanded and/or most expanded stage according to the present invention.

FIG. 10 shows arrangement of plurality of flap cuts placed considering the human foot anatomy with respect to the expansion of the sole according to the present invention.

Figure 11A:
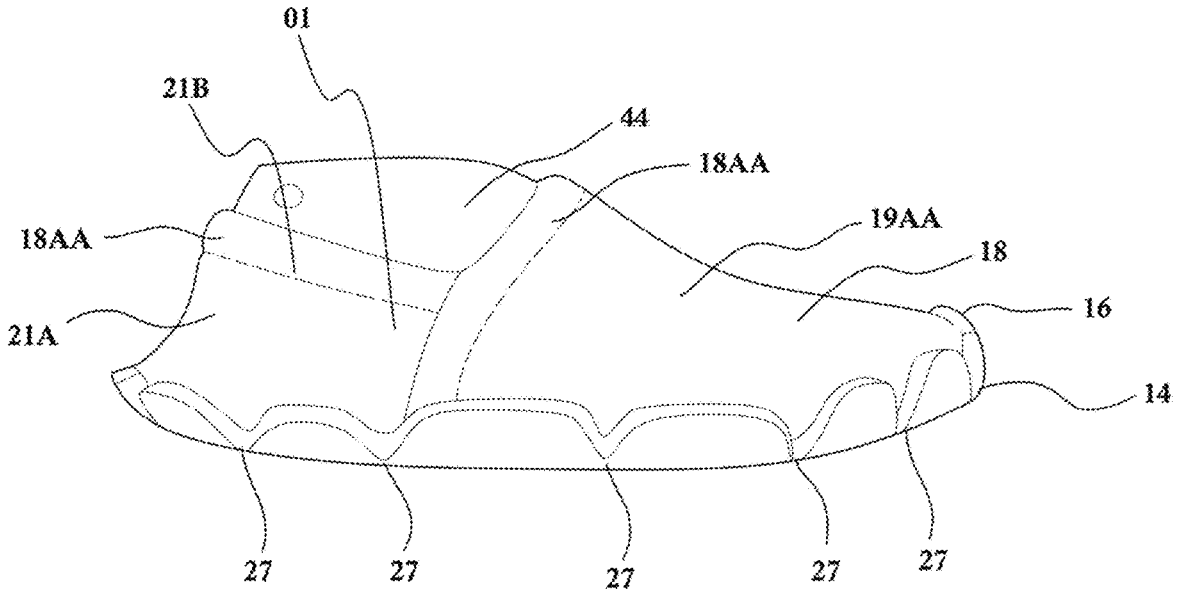

FIG. 11A shows an expandable shoe accommodating a size 22 mould/last according to one of the embodiments of the present invention.

Figure 11B:
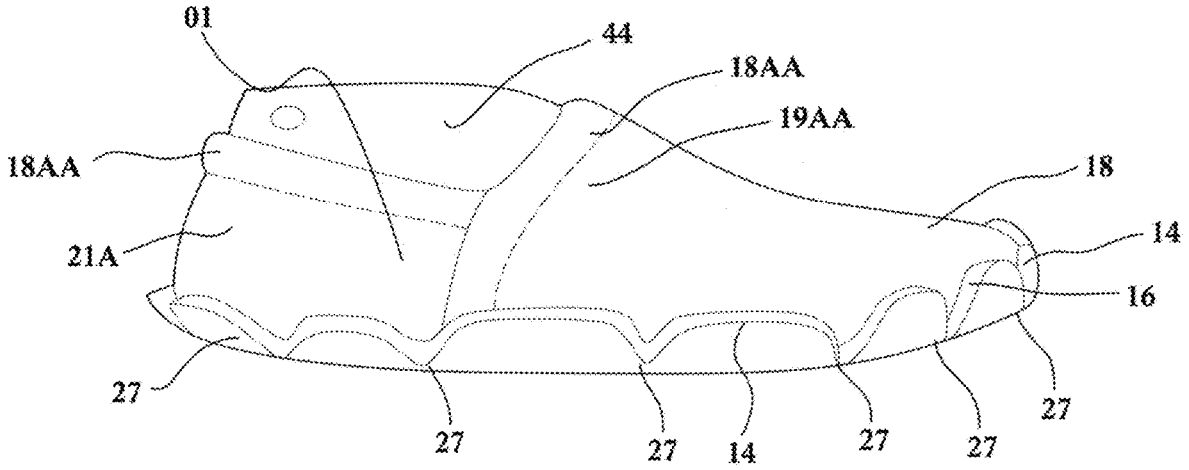

FIG. 11B shows the same shoe (as seen in FIG. 3) accommodating a size 24 mould/last according to one of the embodiments of the present invention.

Figure 12:
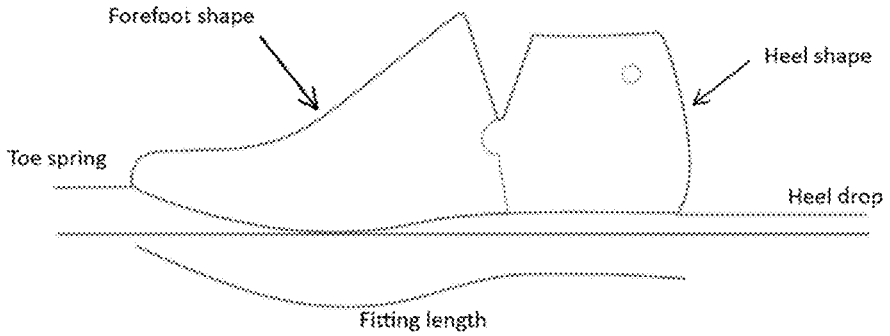

FIG. 12 illustrates a conventional last having a typical forefoot shape, heel shape, a toe spring and a heel drop.

Figure 12A:
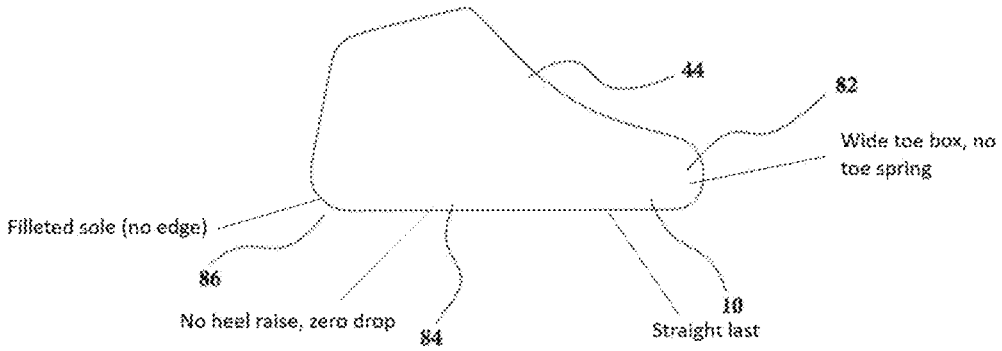
Figure 12B:
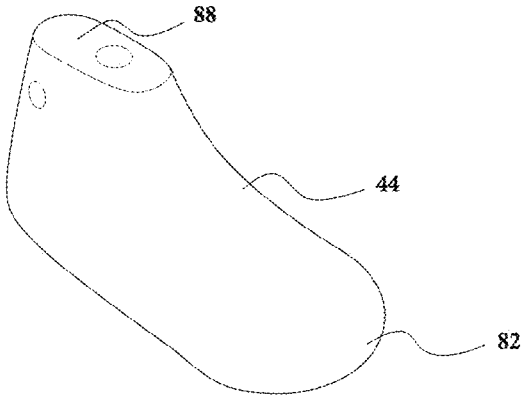
Figure 12C:
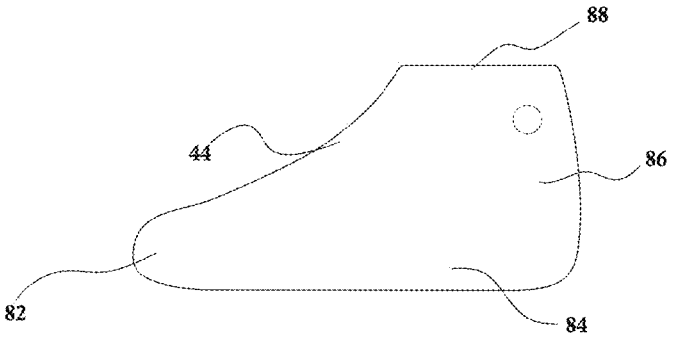

FIGS. 12A to 12C show the right, perspective and left side views respectively of the last used for the expandable shoes of the present invention.

FIG. 12D to I show bottom, right, top, front, back and perspective views respectively of the last of FIGS. 12B and C used for the expandable shoes of the present invention.

FIGS. 13A to K illustrate the last as shown in FIGS. 12A to 12I designed taking reference from human foot anatomy, shape, features and variations found in them in various positions.

Figure 14A:
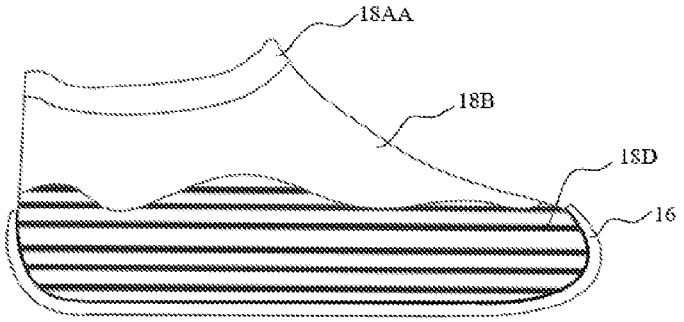

FIG. 14A illustrates an expandable shoe with hatched area to indicate a thicker and stiffer knitting pattern for fabric upper construction according to one embodiment of the present invention. This pattern is intended to provide lateral and base stability to the foot with its sturdiness.

Figure 14B:
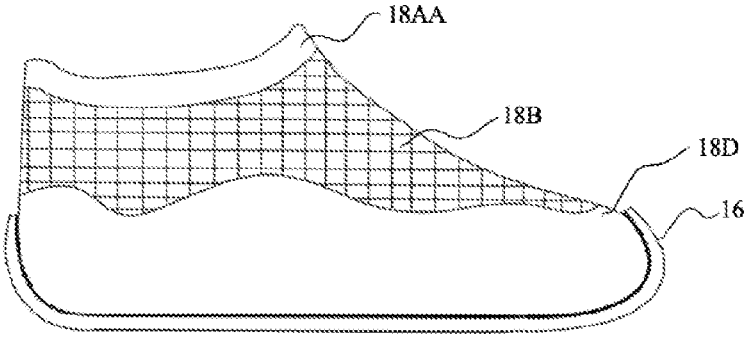

FIG. 14B illustrates a cross hatched area to indicate a thinner, stretchier pattern than the previous FIG. 14A for fabric upper construction wherein the thin and stretchy pattern comfortably drapes the foot and also provides moisture wicking and ventilation according to another embodiment of the present invention. It stretches well during expansion to accommodate grown sizes.

Figure 14C:
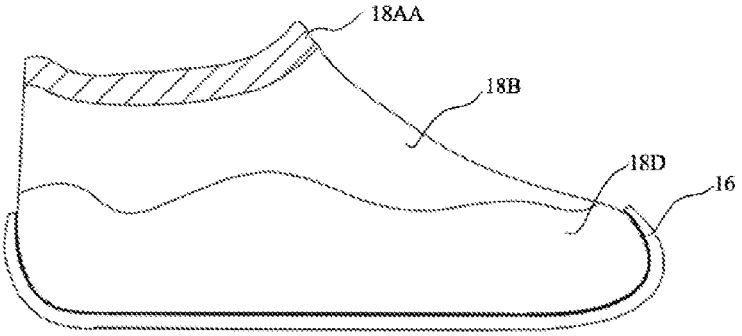

FIG. 14C illustrates an expandable shoe with hatched area to indicate a very thin, light and elastic knitting pattern for fabric upper construction wherein this pattern is located in the collar area of the shoe and is highly stretchable to allow easy and comfortable entry of the foot in the shoe according to another embodiment of the present invention.

Figure 14D:
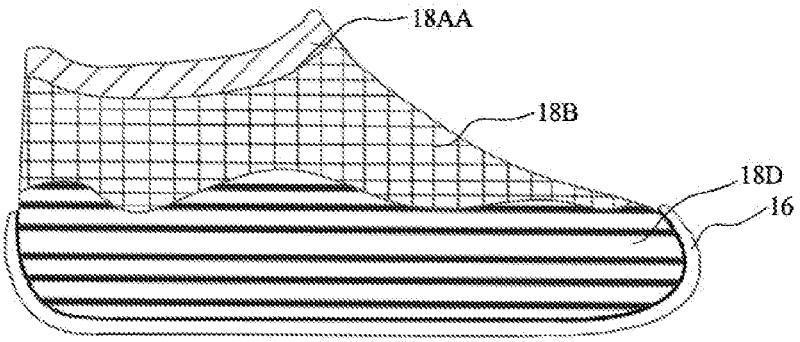

FIG. 14D illustrates expandable shoe with different hatched areas to indicate different knitting patterns according to another embodiment of the present invention.

Figure 14E:
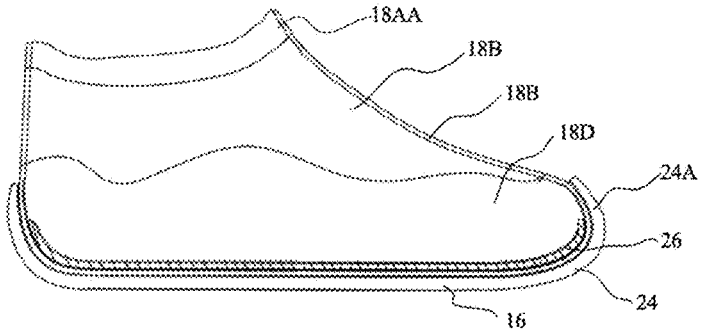

FIG. 14E illustrates expandable shoe with hatched object to indicate an insole inserted after manufacturing the shoe according to the present invention.

Figure 15A:
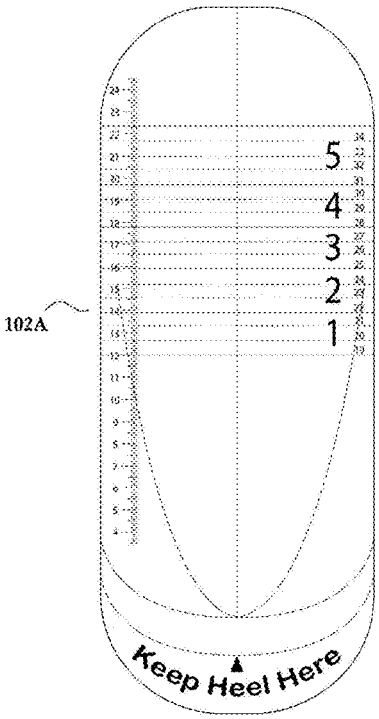
Figure 15B:
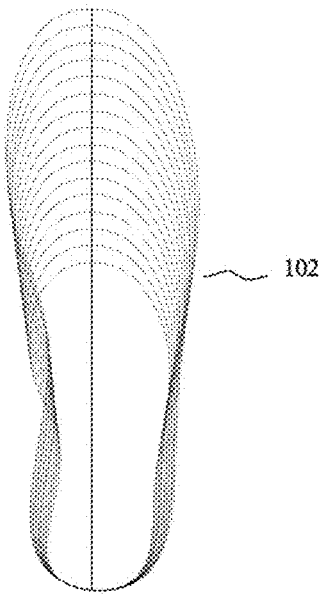

FIGS. 15A&B illustrate the growth Pattern in Children mapped with respect to age.

Figure 16:
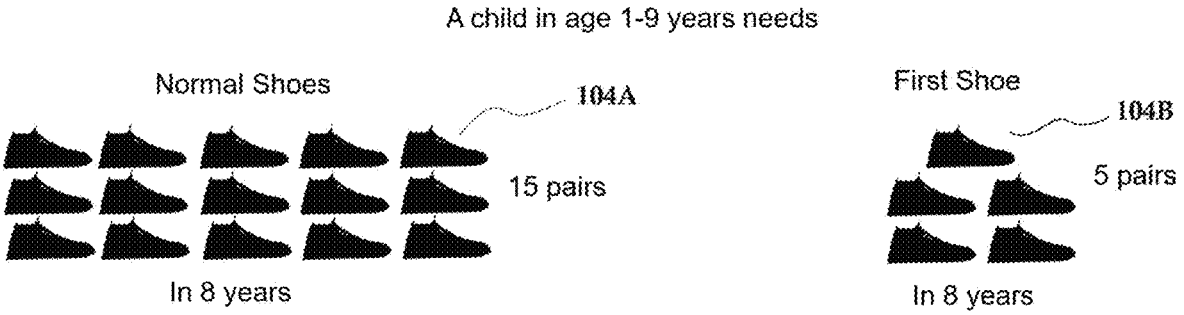

FIG. 16 illustrates a comparative example of usage between conventional and expandable shoes of the present invention by a child during 1-9 years of age.

DETAILED DESCRIPTION OF THE INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention.

Figure 1:
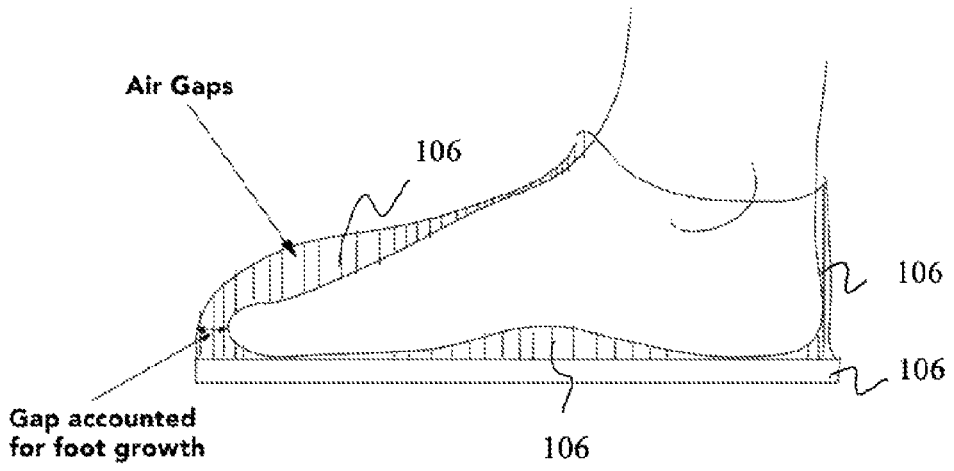
FIG. 1 illustrates conventional shoes.

As shown in FIG. 1, conventional shoes have space accounted for growth of the foot ahead of the toes as a tradition. This space and the overall build of conventional shoes create a lot of air gaps 106 in the shoe. As can be seen, the air gaps 106 are visible being in all directions i.e. front, back, sides, top and bottom. The air gaps 106 makes the foot move inside the shoe while the wearer/user performs activities such as running, and hampers the wearer's performance. Using fasteners such as laces and straps does not solve the problem fully. No two feet are the same in shape and conventional shoes are built to cater to average sizes, therefore air gaps 106 still exist in each wearer's/user's shoe.

Figure 2A:
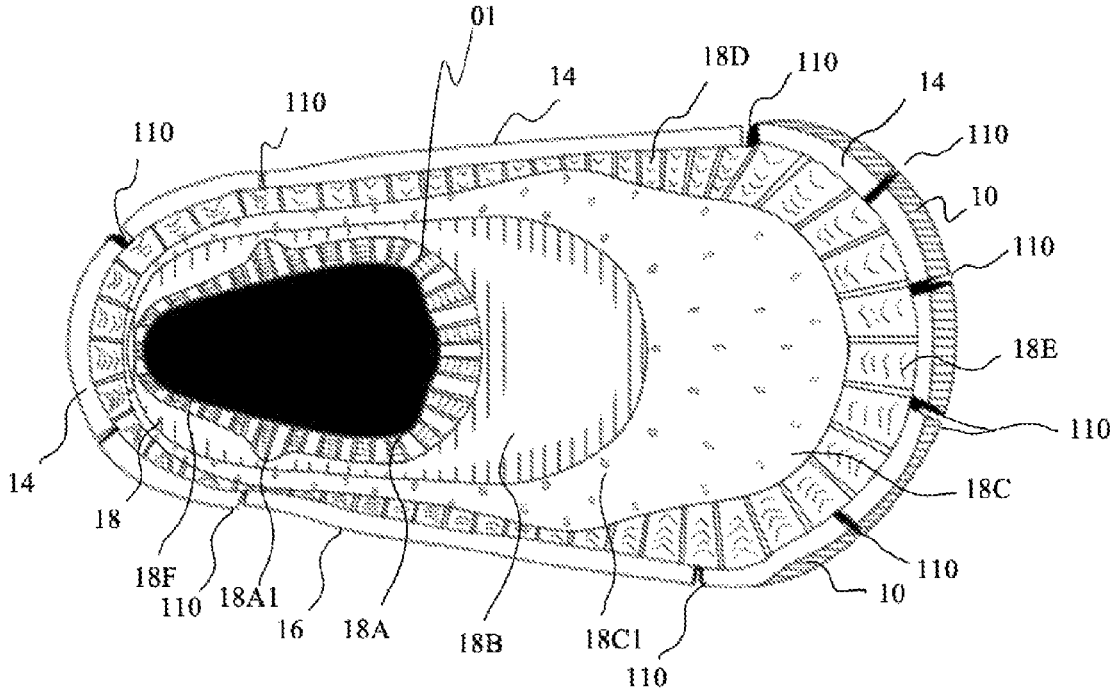
FIG. 2A shows a top view of the expandable shoe according to one embodiment of the present invention.
Figure 2B:
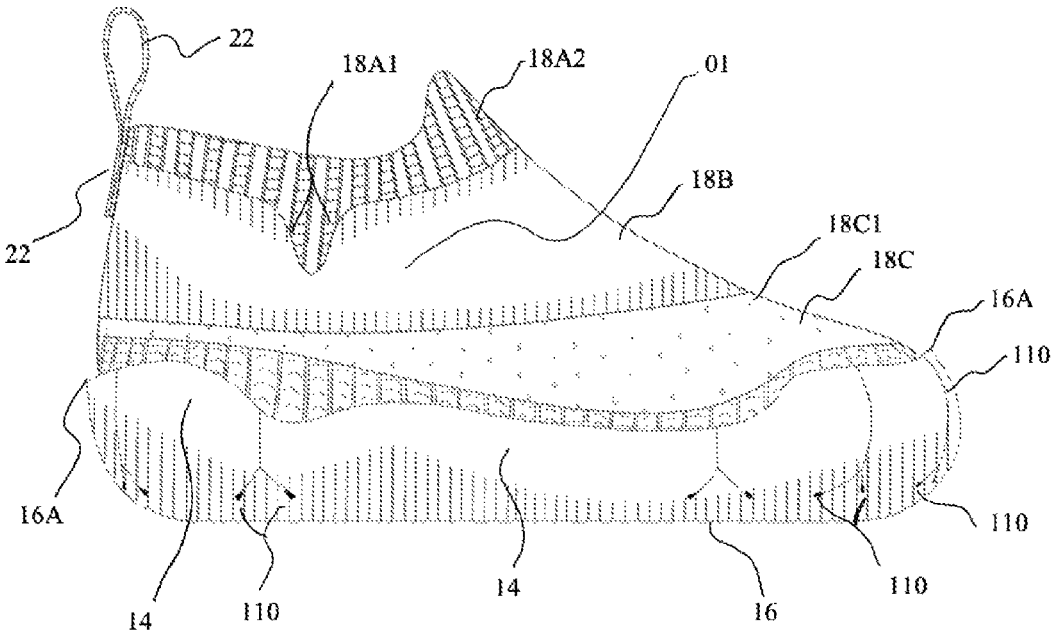
FIG. 2B shows a side view of the expandable shoe of FIG. 2A.
Figure 2C:
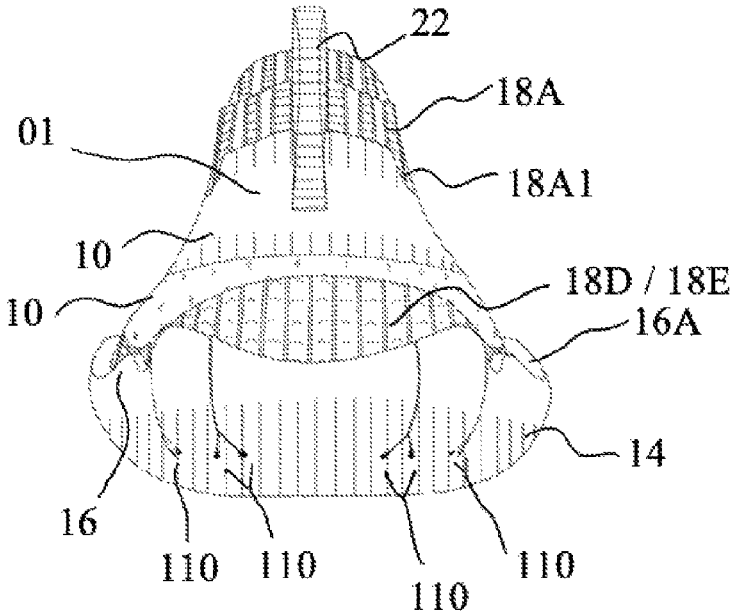
FIGS. 2C & 2D show a back and front view respectively of the expandable shoe of FIG. 2A.
Figure 2D:
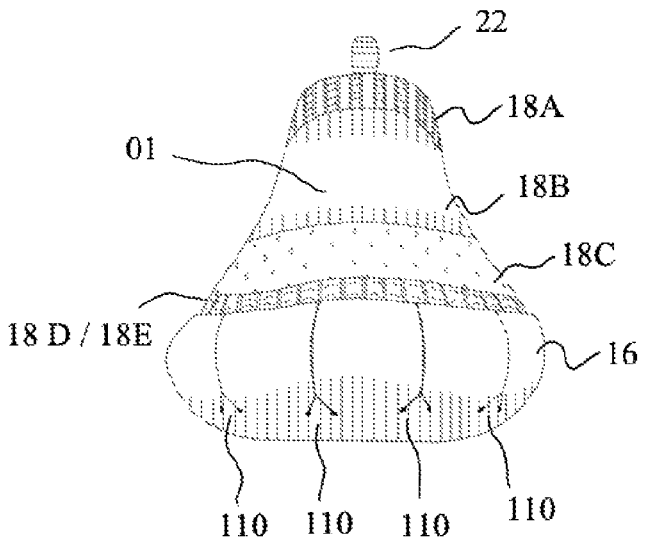
Figure 2E:
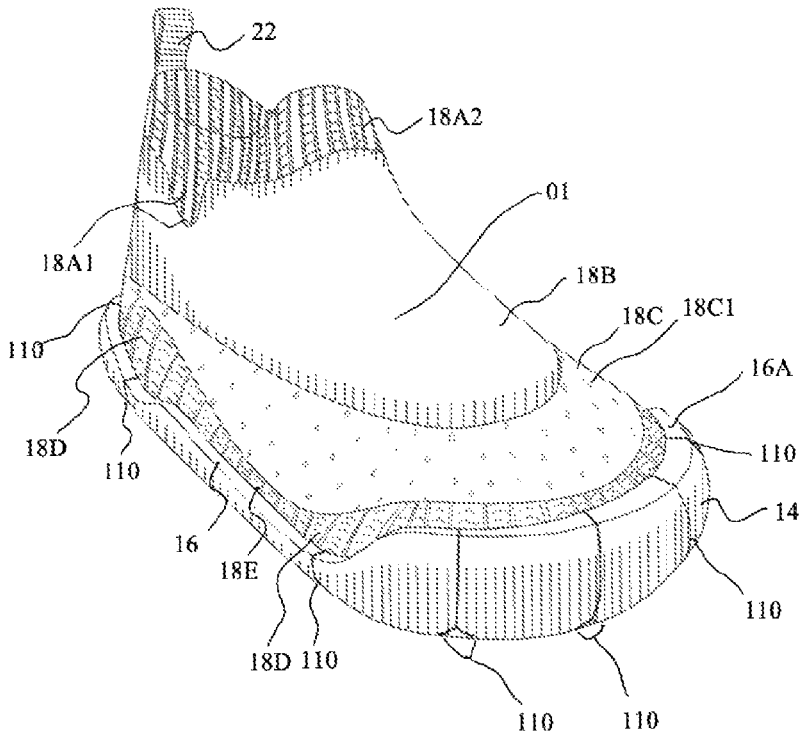
FIG. 2E shows a perspective view of the expandable shoe of FIG. 2A.
Figure 2F:
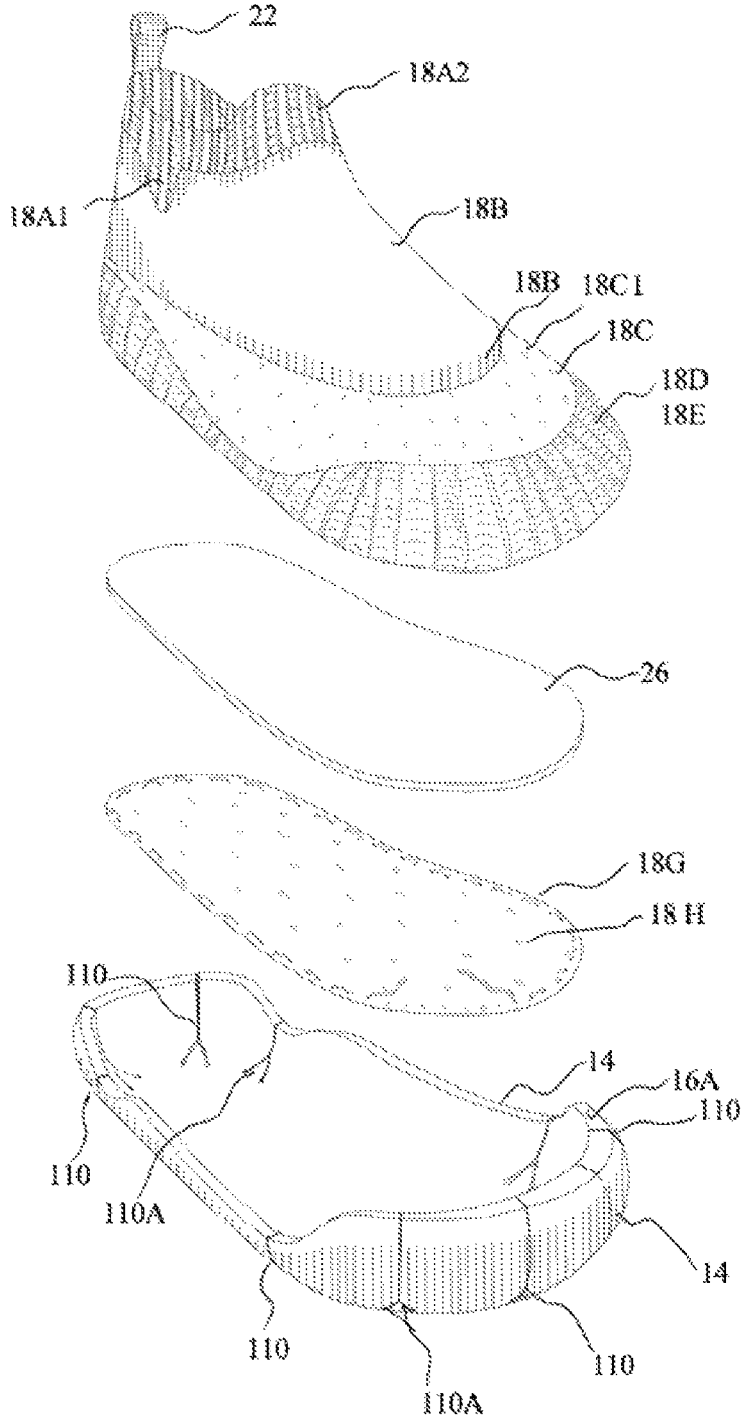
FIG. 2F illustrates an exploded view of the construction of the expandable shoe of FIG. 2A.

Reference is now made to FIG. 2A, which shows a top view of the expandable shoe 01 according to one of the embodiments of the present invention, FIG. 2B which shows a side view of the expandable shoe 01 of FIG. 2A and FIGS. 2C & 2D which show a back and front view respectively of the expandable shoe 01 of FIG. 2A, FIG. 2E which shows a perspective view of the expandable shoe 01 of FIG. 2A, FIG. 2F which illustrates an exploded view of the construction of the expandable shoe 01 of FIG. 2A.

As can be seen in FIGS. 2A to 2F, the expandable shoe 01 essentially consist of two major components i.e. a sole 16 which protects the base of the foot from the ground and an upper 18 which covers the top of the foot.

The sole 16 has been designed with a plurality of flaps 14 growing upwards from the bottom surface of the sole 16 around the sole's 16 circumference. These flaps 14 are configured to encompass the foot of a wearer/user from all the sides. The flaps 14 are separated by plurality of flap cuts 110 being positioned at different locations in the sole 16 such that having some and/or equal and/or more distance between the flaps 14 and flap cuts 110. The sole 16 has a sole top line 16A (FIG. 2E) and is provided with base line having sole grips 10.

The upper 18 is made of stretchy, elastic knitted material which is stuck inside the sole 16 being inseparable, with the flaps 14 encompassing the upper 18. The upper 18 and the sole 16 are assembled together as one shoe 01 through known means and manner such as, not being limited to, strobel construction and cold cement construction process. The upper 18 is knitted and prepared to its form in that the upper 18 comprises, a stretchable collar 18A with omni expansion feature(s) 18A1 and having a collar tongue 18A2 (as shown in FIGS. 2B and 2E) and an upper top line 18F, a stretchable upper vamp 18B being inseparably stitched/connected to the stretchable collar 18A, a stretchable lower vamp 18C being inseparably stitched/connected to the stretchable upper vamp 18B, a stretchable thick stiff knit pattern 18D being inseparably stitched/connected to the stretchable lower vamp 18C, the stretchable thick stiff knit pattern 18D in turn being inseparably stitched/connected to a lateral and base stability for foot 18E. The stretchable lower vamp 18C is provided with plurality of breathable ventilation holes 18C1 which helps the foot to perspire when the user is wearing the expandable shoe 01.

A pullstrap 22 is inseparably attached to the upper 18 on back side of the shoe 01 as shown in FIGS. 2B, 2C and 2E. The pullstrap 22 helps the wearer/user in wearing the shoe 01.

The upper 18 is then placed on a foot mould/last 44 as shown in FIG. 2G and a fabric footbed is stitched to the underside of the upper 18 with the last 44 inside, using strobel construction. An insole 26 goes inside the upper 18. This finished upper 18 'sock' with the last 44 inside is cemented inside a moulded sole 36 with adhesives and a press. This process is called cold cement construction.

The sole 16 and the upper 18 work in conjunction with each other. The sole 16 having expandable feature has a sturdy construction and configured to provide comfort to a wearer/user. The sole 16 has a sole topline 16A (as shown in FIGS. 2C, 2E and 2F) which is configured to provide protection to the expandable shoe 01 and its wearer/user. The sole topline 16A runs through the entire upper periphery of the sole 16 having equal width in that the sole topline 16A has a run at varying depth on left and right sides of the sole 16 in comparison to the front and back of the sole 16. As such the sole topline 16A has a larger height on front and back of the sole 16 in comparison to the height on the left and right sides of the sole 16. In alternative embodiments, the sole topline 16A can have varying widths, for example larger widths in front and back in comparison to the sides of the expandable shoe 01. When a larger sized foot enters the expandable shoe 01, the flaps 14 on the circumference of the sole act like petals of a flower and open up outwards, thereby supporting the foot and acting as and providing an increased surface area of the sole 16, while the upper 18 also stretches to accommodate the foot inside the expandable shoe 01. The elasticity of the knitted upper 18 restores the expandable shoe 01 to its original form after the foot is taken out of it. This feature not only makes the expandable shoes 01 more comfortable by adapting to wearer's feet, but also allows multiple sizes worth of usage prolonging its life and being a sustainable alternative to conventional shoes.

As can be seen, the flaps 14 of the sole 16 have a unique and new design feature added to conventional sole design. These flaps 14 open up according to the wearer's foot shape just as much and wherever needed. Every flap 14 will open up on different levels depending on different foot shapes of different wearers/users.

Any two persons can have the same length of feet but different widths or thicknesses. Conventionally, the same size of shoes will be available to both the persons, which will not fit either of them properly. Sometimes, even the left and right foot differ slightly in terms of shape. The expandable shoe 01 of the invention adapts to individual dimensions and features of every foot, and the flaps 14 open up or retract accordingly. This benefits the user in great levels of comfort.

As can be seen in FIG. 2F, the upper 18 of the expandable shoe 01 is a breathable, mesh, knitted fabric which is stretchable and soft on the skin. The upper 18 provides all round protection to the feet yet keeping the expandable shoe 01 lightweight. The upper 18 material absorbs moisture and sweat and evaporates it on the outside, keeping the user's feet dry and ventilated. The stretchable and elastic upper 18 coupled with the expanding sole 16 makes the need of any fasteners such as laces, straps and zips to be completely optional.

Further as shown in FIG. 2F, an insole 26 is provided above an upper strobel board 18G having upper sock binding stitch 18H which in turn is received by the inner surface 12 of the sole 16. The topline 16A of the sole 16 has a tapered end 24A which joins to the upper 18 of the expandable shoe 01 seamlessly as shown in FIG. 2E in finished form. The flaps 14 in the sole 16 are partitioned with a plurality of flexible inverted 'Y' shaped cuts 110 with rounded vertices 110A. The flaps 14 are pushed outward from the flap before expansion 14A outward and the curved walls of the flaps 14 bend outwards to accommodate the exact foot making the footprint of the sole 16 larger. However, the cuts 110 are not limited to an inverted Y shape and can be configured in any other shape to achieve the expansion of sole 16 in intended manner. These cuts 110 enhance the movement and expansion of the flaps 14 and allow further fine tuned adjustment to the foot shape.

Figure 3A:
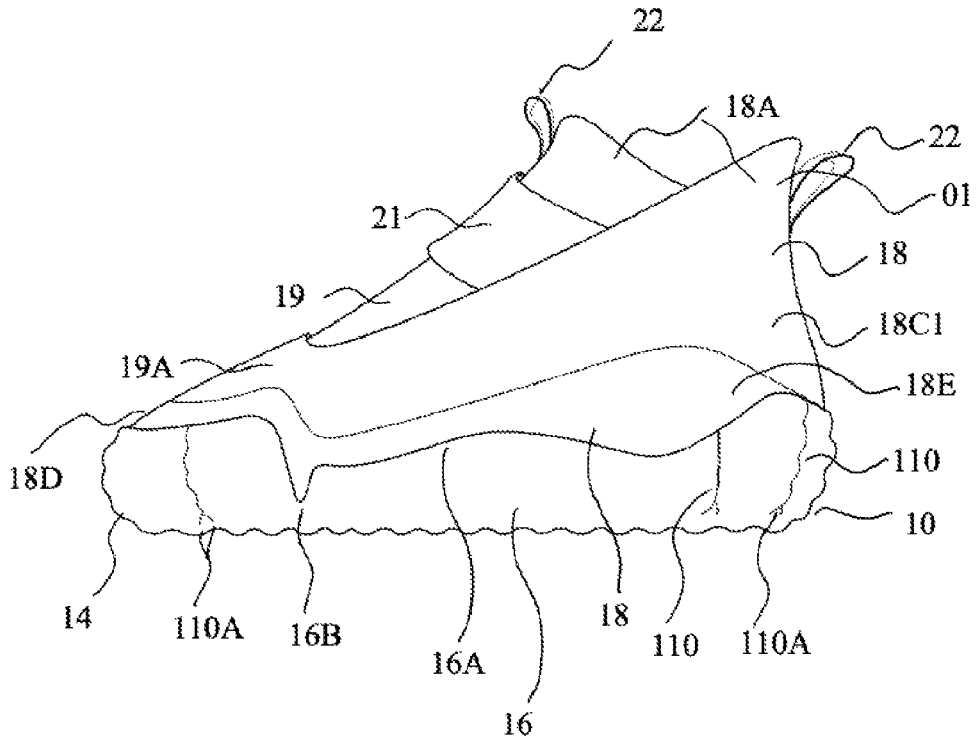
FIGS. 3A & 3B show perspective views from side respectively of the expandable shoe according to another embodiment of the present invention.
Figure 3B:
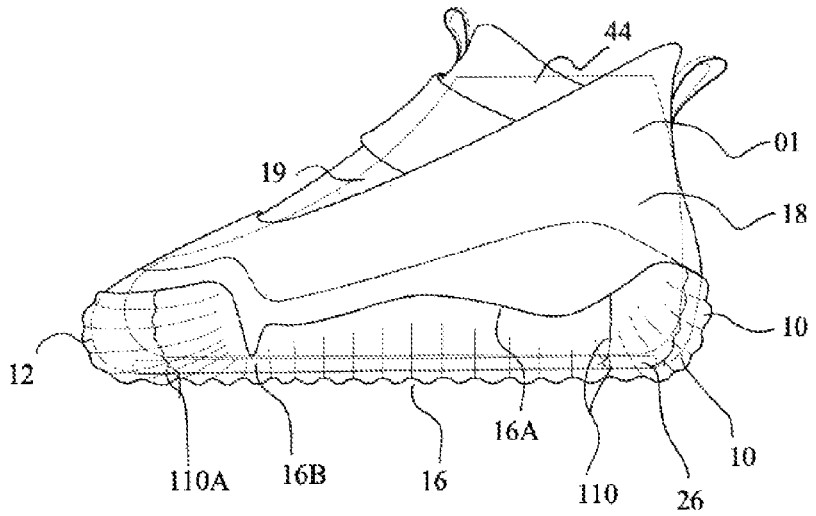

Referring now to FIGS. 3A & 3B, they show perspective views from side respectively of the expandable shoe 01 according to another embodiment of the present invention. The expandable shoe 01 is provided with a sole 16 with a base line with sole grips 10 having flaps 14 with a plurality of inverted Y cuts 110 with rounded vertices 110A. The flaps 14 are pushed outward from the flap before expansion outward and the curved walls of the flaps 14 bend outwards to accommodate the exact foot making the footprint of the sole 16 larger. However, the cuts 110 are not limited to an inverted Y shape and can be configured in any other shape to achieve the expansion of sole 16 in intended manner. The sole 16 also has a sole topline 16A and a flexible V cut 16B. The V cut 16B in sole improves flexibility of the sole 16 and helps in the natural fold in foot while movement.

An upper 18 made of stretchy, elastic knitted material which is stuck inside the sole 16 being inseparable, with the flaps 14 encompassing the upper 18. The upper 18 and the sole 16 are assembled together as one shoe 01. The upper 18 is knitted and prepared to its form in that the upper 18 comprises, a stretchable collar 18A, an elastic band 21, a tongue 19, a stretchable vamp 19A each of them being inseparably stitched/connected in that the stretchable vamp 19A is inseparably stitched/connected to a stretchable thick stiff knit pattern 18D having a lateral and base stability for foot 18E.

A pullstrap 22 is inseparably attached to the stretchable collar 18A on front side and another pullstrap 22 is attached to the upper 18 on the back side of the shoe 01. The pullstrap 22 helps the wearer/user in wearing the shoe 01. The stretchable vamp 19A is provided with plurality of breathable ventilation holes 18C1 which helps the foot to perspire when the user is wearing the expandable shoe 01. The expansion and workability of the flexible inverted Y shape cuts 110 is similar to the embodiments of the inverted Y cuts 110 discussed herein-above with respect to FIGS. 2A-2F.

FIG. 4A to 4F show the orthographic views including top, side, front and cross-sectional views respectively of the sole 16 and its flaps 14 according to one embodiment of the present invention. As can be seen in FIG. 4D which illustrates the sole cross section 24, the thickness of the sole 16 is uniform through most of the cross section 24, but tapers 24A towards the edge at the top of the sole 16. The flaps 14 are separated by a plurality of flexible V cuts 27 being made in the flaps 14. The sole 16 having a sole inner surface 12 to receive the foot of the wearer/user thereon. The flexible V cuts 27 can be arranged in the sole 16 in an equidistant manner or alternatively in a manner having varying distance between two such V cuts 27. Having such flexible V cuts 27, when a larger sized foot enters the expandable shoe 01, the flaps 14 on the circumference of the sole 16 act like petals of a flower and open up outwards, thereby supporting the foot and acting as and providing an increased surface area of the sole 16 in order to accommodate the feet inside the expandable shoe 01 comfortably of the wearer/user. This feature of the sole 16 having flexible V cuts 27 not only makes the expandable shoes 01 more comfortable by adapting to wearer's feet, but also allows multiple sizes worth of usage prolonging its life and being a sustainable alternative to conventional shoes.

Referring now to FIG. 4F, it shows a perspective view of the sole 16 and its flaps 14 according to another embodiment of the present invention in that instead of a flexible V cut 27 the flaps 14 are separated by a plurality of flexible inverted Y cuts 110. The sole 16 has a sole topline 16A and having a sole inner surface 12 to receive the foot of the wearer/user thereon. Having such flexible Y cuts 110, when a larger sized foot enters the expandable shoe 01, the flaps 14 on the circumference of the sole 16 act like petals of a flower and open up outwards, thereby supporting the foot and acting as and providing an increased surface area due greater expansion capabilities of the Y cuts 110 of the sole 16 in order to accommodate the feet inside the expandable shoe 01 comfortably of the wearer/user. This feature of the sole 16 having flexible Y cuts 110 not only makes the expandable shoes 01 more comfortable by adapting to wearer's feet, but also allows multiple sizes worth of usage prolonging its life and being a sustainable alternative to conventional shoes.

Further, the sole 16 of the invention can be added with structural strengtheners such as ribs 25 on the inner and outer side of the sole 16 as seen in FIGS. 5A &5B. Ribs 25 are thin protrusions that extend perpendicularly widthwise from a wall or plane to provide added stiffness and strength to the sole 16. As shown in FIG. 5A, the ribs 25 are further provided with break/cut on inner side of the sole 16 in order to support expansion of the flaps 14. Likewise, as shown in FIG. 5B, the ribs 25 are provided on outer side of the sole 16 to support expansion of the flaps 14.

The ribs 25 smoothly merge with wall cross section taper 24AA of the sole 16 towards its end edges. The ribs 25 increase the strength of the sole 16 without making the walls of the sole 16 thicker, reducing the sole 16 weight, requiring lesser material and saving the sole 16 from other defects in the manufacturing process. These ribs 25 help the sole 16 retain its original form being in an unexpanded state and its outsole 23. Thus, the ribs 25 provides additional enough support enabling expansion of the sole 16 and its flaps 14. However, the retention to unexpanded state is not a necessity but would depend on factors such as its dimensions, material composition of sole 16 and other such manufacturing factors. The supports like the ribs 25 in the sole 16 acts like a skeletal structure for the sole 16 and help in holding the flaps 14 upwards allowing free and smooth expansion. Taking into account the above, the position and workability of the ribs can be changed based on flap 14 width for stability.

FIG. 6 shows the sole 16 and its flaps 14 in a perspective view according to the present invention. As can be seen, both the expanded and unexpanded position of the sole 16 with flaps 14 are illustrated. The flaps 14 in the sole 16 are partitioned with a plurality of flexible inverted 'Y' shaped cuts 110 with rounded vertices 110A. When a foot of the wearer/user is received within the sole 16, a force is exerted outward on the walls of the sole 16 wherein the flexible inverted Y cuts 110 being in an original un-expanded position expands due to the expansion of the inverted Y cut rounded vertices 110A and expand the flaps 14 into expanded flap 14AA.

Referring further to FIG. 6 and FIGS. 6A to 6H which show the expansion of the flaps 14 of the sole 16 from unexpanded to expanded state due to the opening of the flaps before expansion 14A. As can be seen, the sole 16 of the expandable shoe 01 goes through gradual expansion of the sole 16 in FIG. 6B where there is no expansion in flaps 14A to FIG. 7D where the expansion in flaps 14 is maximum. This expansion in flaps 14 depend on the size of the wearer's feet or how that size grows in case of children. As can be seen in FIGS. 6A-6H, the cross section of the sole in this particular embodiment is tapered 24A towards the topline 16A of the sole 16. This taper 24A joins to the upper 18 of the expandable shoe 01 seamlessly as shown in FIG. 6E.

As shown in FIGS. 6, 6A to 6H and 8, the flaps 14 in the sole 16 are partitioned with a plurality of flexible inverted 'Y' shaped cuts 110 with rounded vertices 110A. The flaps 14 are pushed outward from the flap before expansion 14A outward and the curved walls of the flaps 14 bend outwards to accommodate the exact foot making the footprint of the sole 16 larger. However, the cuts 110 are not limited to an inverted Y shape and can be configured in any other shape to achieve the expansion of sole 16 in intended manner. These cuts 110 enhance the movement and expansion of the flaps 14 and allow further fine tuned adjustment to the foot shape. As can be further seen in FIGS. 6A to 6H, the thickness of the sole 16 is uniform through most of the sole cross section 24A. However, to increase the flexibility of the sole 16, the thickness of the sole 16 tapers towards the edge at the sole 16 topline 16A. The outer surface of the sole 16 is provided with sole grip 10.

FIGS. 6I to 6Q show the gradual expansion of the inverted "Y" cuts 110 and the flaps 14 started to have a gradual increase in gaps between them in various views. As the feet gets in the expandable shoe 01, depending on the wearers foot, the flaps 14 move and adapt to the form of the users sole and foot shape. This adaptation of the sole 16 to accommodate varying/increasing sizes is possible for up to 3 sizes. The flaps 14 are pushed outward from its original unexpanded state and the curved walls of the flaps 14 bend outwards to accommodate the exact foot making the footprint of the sole 16 larger. Also, in case of children, the sole 16 expand little by little everyday as the child grows. The sole 16 would be flexible enough to cater to this growth for upto 3 sizes and in no way restrict the shape, growth and health of the child's feet. The rounded vertices of the cut 110A help prevent the cut 110 from tearing along the sole 16.

The gradual and steady sole 16 shape and flap 14 expansion can be seen in FIG. 6R wherein in Step 1 there is no or minimal flap expansion, Step 2 has medium or upto 2 size expansion and Step 3 has full size or upto 3 size expansion of the sole 16.

As shown in FIGS. 7A, 7B, 8A and 8B, the inverted Y cut 110 allows smoother expansion of individual flaps 14 from original unexpanded state to expanded state due to the rounded vertices of the cut 110A. The inverted Y cut 110 also allows three dimensional movements of the individual flaps 14 providing greater fit and comfort. In fact, it is the wearer's feet which decide the movement or expansion or the extent of expansion of each flap 14 according to the structure and shape of their left and right foot respectively. Thus, the arrangement of sole 16 with flaps 14 having inverted Y cuts 110 always gives a bespoke fit to the wearer at all times. The vertices of the cut are rounded 110A and shaped like a circle to avoid tears and snags of flaps 14. This design feature also ensures longer life and usability of the sole 16.

Referring to FIG. 8B, the sole 16 is provided with an elastomer layer 710 in midsole section thereof. This stretchable elastic midsole 710 is pasted or sandwiched in between an inner lining of the sole 16 and the upper 18. As and when the sole 16 expands and the inverted Y cuts 110 open up, the elastic midsole stretches in the inverted "Y" cut gaps 710A creating a protective layer between the sole 16 and the upper 18. The stretchable elastic midsole 710 also takes care of providing extra strength and complete protection to the expandable shoe 01. This elastomer layer 710 could have various other material properties like being non-puncher able, have memory and retain shape of the users feet.

The elastomer mid layer 710 between inner sole 16 and upper 18 could be combined with any of the other embodiments of the "Y" cut mentioned above and is not restricted to FIG. 9.1 to FIG. 9.5.

One of the pasting technique used with respect to the elastomer mid layer 710 is as follows: (i.) The adhesive put on the inner surface of the sole 16 and flap 14 cuts 110 and the same markings of the flap 14 cut 110 positions on the upper 18. The elastomer layer 710 thereafter pasted in between the sole 16 and upper 18. The expansion "Y" cut lines/areas 110A are ensured to be left without adhesives for the elastomer 710. This way it allows expandable Y cut areas 110A to expand freely. (ii) Yet another joinery approach of the elastomer layer 710 is to sew the "Y" cut 110 outline taking the sole 16, mid sole elastomer 710 and the upper 18. Such a joining arrangement ensure that the area in expanded mid sole elastomer 710A is free to move with the 'Y' cut expansion 110A.

This concept and its workability discussed above is applicable to any shape cut vertices other than the inverted 'Y' cut 110, for example, the alternative cuts as shown in FIGS. 9.1, 9.2, 9.3, 9.4 and 9.5. Each of such varying shapes of cuts effectively assist in gradual expansion of sole 16 as per the size of the foot of the wearer/user providing a comfortable experience of use.

In FIG. 9.1 there is a straight cut 210 with a single rounded vertices 210A and another variation of a cut being a "star" cut 310 which has four rounded vertices 310A. FIG. 9.5 illustrates in detail the expansion feature of the "star" cut which has four rounded vertices from being in an original unexpanded state to an expanded state. FIG. 9.2 the sole 16 is provided with a "wave" cut 410 with a single rounded vertices 410A from being in an unexpanded original state to an expanded state. FIG. 9.3 has a "Nib" cut 510 with a single rounded vertices 510A.

Referring to FIG. 9.4, it illustrates two micro cuts 610A on the top line 16A of the sole 16 and a slit 610 cut on the walls of the sole 16. This slit 610 expands with the help of the micro cuts 610A on the top line 16A to expand the sole 16 of the expandable shoe 01.

Referring now to FIG. 10, it can be seen that a plurality of flap cuts locations 14B are placed considering the human foot anatomy with respect to the expansion of the sole 16. The flaps 14 are positioned in the front 14C, the sides 14D and the back 14E of the sole 16. The front flaps 14C helps the frontal portion of the feet expand, the side flaps 14D helps the splay area and the width of the foot expand and accommodate wider feet. The back flaps 14E ensure heel to grow in its natural shape without any obstruction. The flaps 14 are positioned and designed to provide unhindered yet supported growth to the wearer's feet. The expandable shoe 01 is designed to aid and amplify natural unrestricted growth of feet. The sole 16 when expanded should still provide adequate protection even as the gaps in the cuts have increased. Hence, the location of the cuts is driven by the curves of the foot. A plurality of flap 14 cuts 110 (for example, as shown in FIGS. 6A to 6R) are located to accommodate grown sizes of foot without compromising on protection.

The flap cut locations 14B are vital, for proper expansion of the sole 16 and in turn of the shoe 01. The cuts 110 (for example, as shown in FIGS. 6A to 6R) are minimally wide and extend till the sole top line 16A. In this embodiment, the number of flaps 14, not being limited to, are 10-14. The number of flap cuts 110 may vary in different or other shoes. The flaps 14 could be filleted, chamfers or have protective supports on their edges.

FIGS. 11A & 11*b* show an expandable shoe 01 accommodating a size 22 and size 24 natural foot shape last 44 respectively according to one of the embodiments of the present invention. The mint green part is the upper 18, and the black part is the sole 16 having flaps 14 which has expandable feature. The flaps 14 have plurality of flexible V shape cuts 27. The upper 18 of the shoe 01 has collar 18AA made through stitching 21B on the mouth which lets the foot of a user in therethrough. The back side of the upper 18 of the shoe 01 has a heel counter 21A and a vamp 19AA in front portion of the upper 18. The expansion and workability of the flexible V shape cuts 27 is similar to the embodiments of the cuts discussed herein-above. It can be seen that the stretched upper 18 and the expanded sole 16 with flaps 14 open up to accommodate the larger size foot mould/last 44.

Referring to FIG. 12, a conventional last is illustrated having a typical forefoot shape, heel shape, a toe spring and a heel drop. However, such conventional last has a drawback in that it is not a natural foot shape last actually matching to the profile a natural foot. Such a drawback causes discomfort to the wearer/user.

Referring now to FIGS. 12A to 12I, the last 44 (as shown in FIG. 3B) used for the expandable shoes 01 of the present invention is illustrated in various positions. A last is a mechanical form shaped like a human foot. It is a foot shaped mould/last 44, which defines the final manufactured form of the shoe 01. Last 44 is named so because of a common operation in shoe manufacturing known as de-lasting, which occurs at the end/last. In this operation, the foot shaped mould/last 44 is removed from the shoe 01 and the shoe 01 is completed.

Thus, the last 44 is used by shoemakers during the manufacturing and repair of shoes 01. Lasts 44 typically come in pairs and have been made from various materials, including hardwoods, cast iron, and high-density plastics. Lasts 44 come in many styles and sizes, depending on the exact job they are designed for. Though a last 44 is made approximately in the shape of a human foot, the precise shape is tailored to the kind of footwear being made. For example, a formal shoes' last 44 would be designed to have a narrow toe box for aesthetics.

Historically, lasts 44 were typically made from hardwoods and cast iron because these materials retain their shape, even when in contact with wet materials (like leather) and subjected to the mechanical stresses of stretching and shaping shoes on them. Today, wooden lasts are generally used only for bespoke shoemaking, particularly in Europe and North America.

The materials used in modern lasts are chosen to be strong enough to withstand the forces of mass production machinery, such as that applied by pullover machines when bottoming the shoe, and must also be able to hold tacks (known as "lasting tacks"), which are used to hold shoe parts together temporarily before the sole is added. Although hardwoods satisfy these criteria, modern lasts, especially those used by mass production factories in places such as China, are often made from high-density polyethylene plastic (HMW-HDPE), which allows for many tack holes before needing repair. Such plastics also have the benefit that they can be recycled and remoulded when they wear out.

Figure 12D:
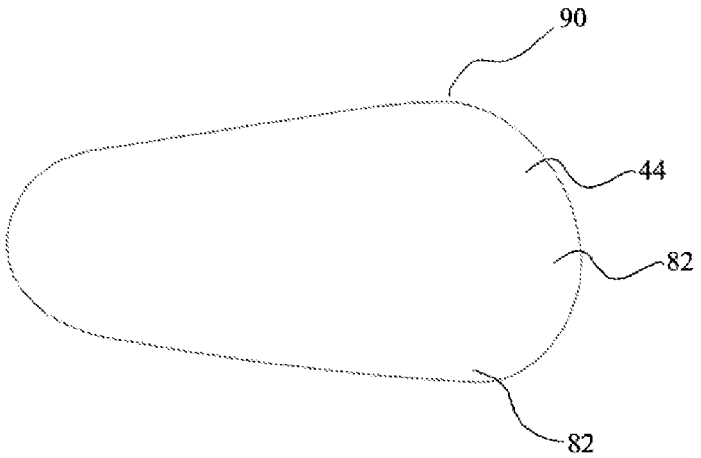
Figure 12E:
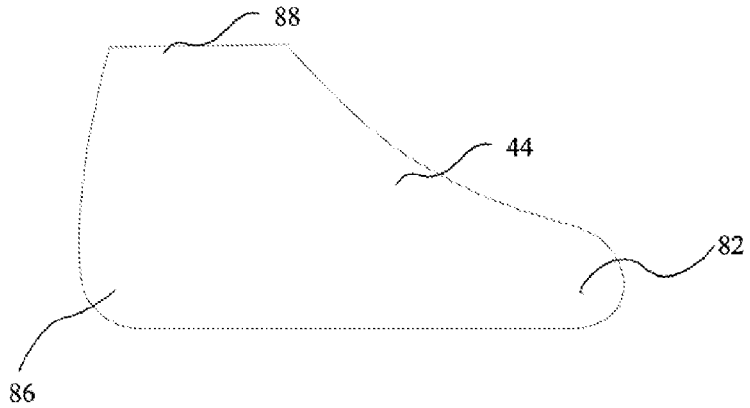
Figure 12F:
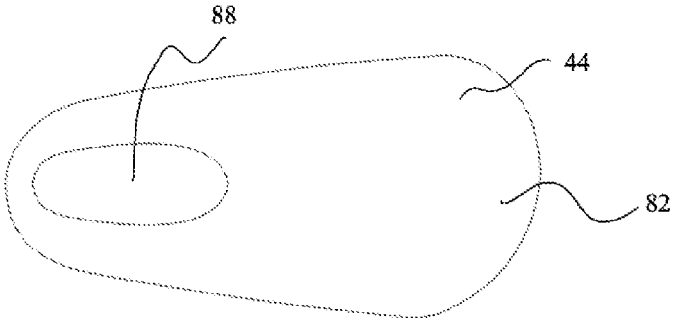
Figure 12G:
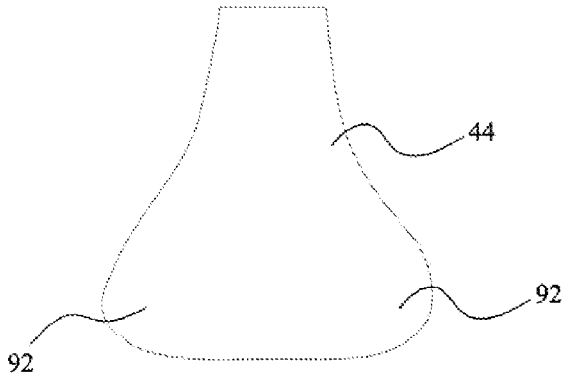
Figure 12H:
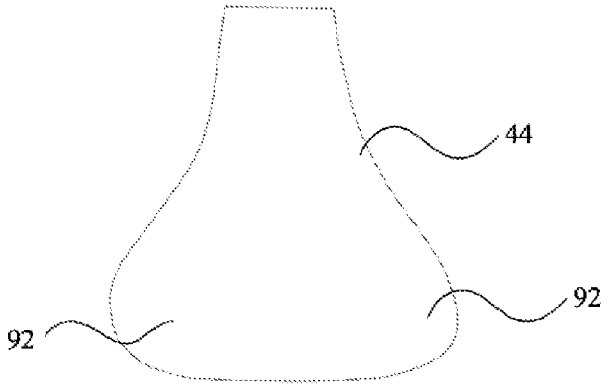

As can be seen in FIGS. 12A to 12I, the last 44 (as shown in FIG. 3B) required for the present invention is specifically designed with an objective of keeping the foot comfort and health as primary focus. The last 44 in FIG. 12A to FIG. 12I has a last top 88 and a wide toe box 82 in the front which is different in that most commonly generic shoe lasts are formed with a narrow front i.e. a narrow toe box as shown in FIG. 12. The wide toe box 82 is given to adhere to the natural footshape of adults and children. The wide areas allows unhindered growth. Since the last 44 governs the shape, size, fit and look of the entire shoe 01, it is important to have this incorporated at the "last level." Moreover, last 44 in FIGS. 12A to 12I has a straight base line 10, no toe spring and a zero heel raise 86 or drop 84. The last 44 of the invention does not have no sole edge line but is no edge filleted last 92 as shown in FIGS. 12G & 12H. The last 44 is designed to manufacture shoes which resemble the human foot anatomy as much as possible, rather than to any fashion aesthetic style. The last 44 design of the invention prefers foot comfort, health and functionality over contemporary shoe aesthetics, such as a wide toe box 82 instead of a narrow one, zero drop, no toe raise and no heel stack height. The last 44 has a rounded profile 90 as shown in FIG. 12D.

Figure 12I:
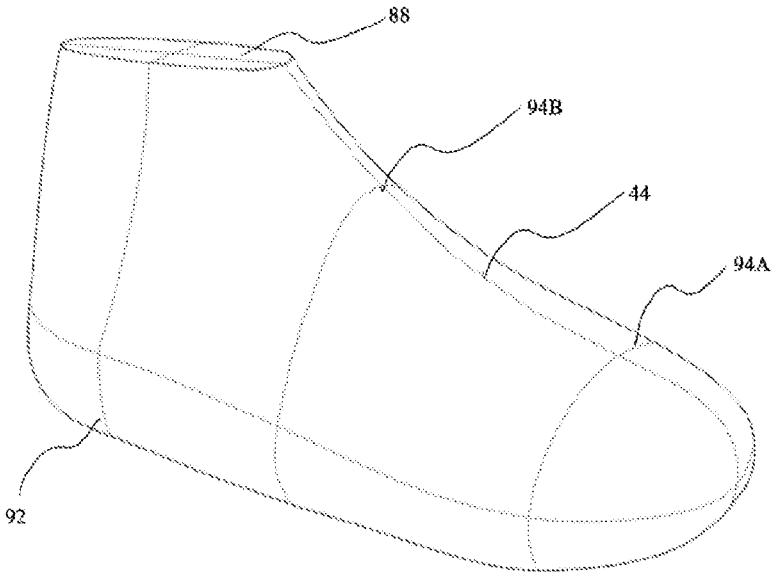
Figure 13G:
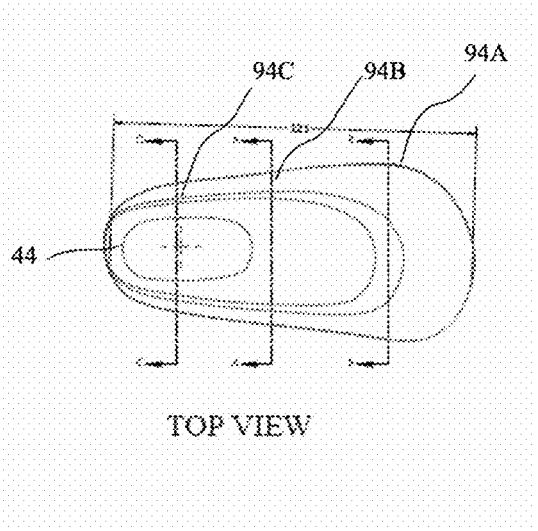
Figure 13H:
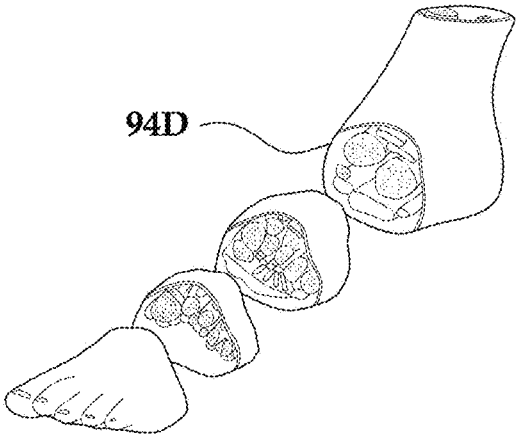
Figures 13I, 13J, 13K:
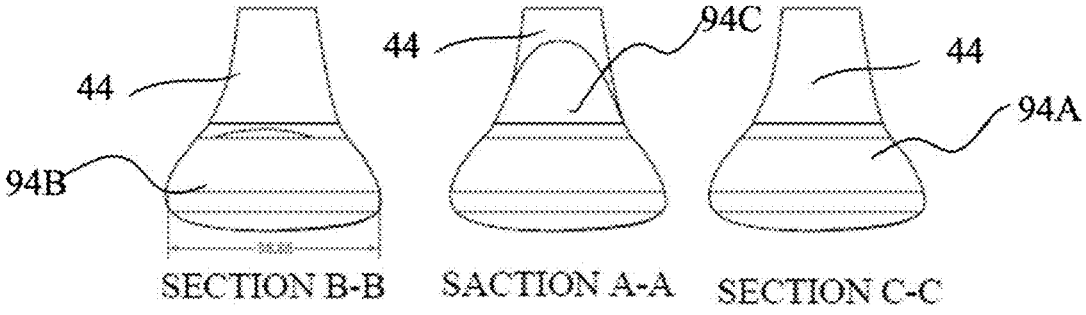

The last 44 as shown in FIG. 12I has been designed taking reference from human foot anatomy 94D, shape, features and variations found in them which are illustrated in FIGS. 13A to K. The last 44 has its contours, cross sections 94B, 94C and curves inspired from the human foot. The last's base/sole is rounded 90 and has no definite edge line unlike conventional lasts. Thus, the last 44 of the invention resembles the natural foot shape, and the sole of a human foot 94D. The last 44 for the present invention also changes according to the age group of the user for whom the shoe 01 is being made for.

Referring to FIG. 14A, it illustrates an expandable shoe 01 having a sole 16, a collar 18AA and a stretchable upper vamp 18B inseparably being attached with hatched area to indicate a thicker and stiffer knitting pattern 18D for fabric upper 18 construction according to one embodiment of the present invention. This pattern 18D is intended to provide lateral and base stability to the foot with its sturdiness.

FIG. 14B illustrates an expandable shoe 01 having a sole 16, a collar 18AA and a stretchable upper vamp 18B a cross hatched area to indicate a thinner, stretchier pattern than the previous FIG. 14A for fabric upper 18 construction wherein the thin and stretchy pattern comfortably drapes the foot and also provides moisture wicking and ventilation according to another embodiment of the present invention. It stretches well during expansion to accommodate grown sizes.

FIG. 14C illustrates an expandable shoe 01 having a sole 16, a collar 18AA and a stretchable upper vamp 18B with hatched area to indicate a very thin, light and elastic knitting pattern for fabric upper 18 construction wherein this pattern is located in the collar area of the shoe 01 and is highly stretchable to allow easy and comfortable entry of the foot in the shoe according to another embodiment of the present invention.

FIG. 14D illustrates expandable shoe 01 with different hatched areas to indicate different knitting patterns having a sole 16, a collar 18AA and a stretchable upper vamp 18B inseparably being attached with hatched area to indicate a thicker and stiffer knitting pattern 18D for fabric upper 18 construction according to another embodiment of the present invention.

FIG. 14E illustrates expandable shoe 01 with hatched object to indicate an insole 26 having a width being shown by cross section 24 inserted after manufacturing the shoe 01 having a sole 16 with a taper 24A, a collar 18AA and a stretchable upper vamp 18B inseparably being attached with hatched area to indicate a thicker and stiffer knitting pattern 18D for fabric upper 18 construction according to the present invention.

For example, to explain the above objectives of the present invention, growth pattern in Children mapped with respect to age is provided in following Tables:

TABLE 1

| Age | Span | Foot length | Growth Patterns |
|---|---|---|---|
| 12-15 months | 3 months | 12.1 cm | Super |
| 15-18 months | 3 months | 12.7 cm | Rapid |
| 18-21 months | 3 months | 13.4 cm | Growth |
| 21-24 months | 3 months | 14 cm | |
| 2 years-2 years 4 months | 4 months | 14.7 cm | Rapid |
| 2 years 4 months-2 years 8 months | 4 months | 15.3 cm | Growth |
| 2 years 8 months-3 years | 4 months | 16 cm | |
| 3 years-3 years 4 months | 4 months | 16.7 cm | |
| 3 years 4 months-3 years 8 months | 4 months | 17.3 cm | |
| 3 years 8 months-4 years | 4 months | 18 cm | |
| 4 years-4 years 10 months | 10 months | 18.6 cm | Consis- |
| 4 years 10 months-5 years 8 monnths | 10 months | 19.3 cm | tent |
| 5 years 8 months-6 years 6 months | 10 months | 19.9 cm | Growth |
| 6 years 6 months-7 years 4 months | 10 months | 20.6 cm | |
| 7 years 4 months-8 years 2 months | 10 months | 21.2 cm | |
| 8 years 2 months-9 years | 10 months | 23.9 cm | |

TABLE 2

| Series | Age | Span | Foot length | Growth | Size (EU) | Size (India) |
|---|---|---|---|---|---|---|
| Series 1 | 12-15 months | 3 months | 12.1 cm | — | 20 | 18 |
| | 15-18 months | 3 months | 12.7 cm | 6 mm | 21 | 19 |
| | 18-21 months | 3 months | 13.4 cm | 7 mm | 22 | 20 |
| | 21-24 months | 3 months | 14 cm | 6 mm | 23 | 21 |
| Series 2 | 2 years-2 years 4 months | 4 months | 14.7 cm | 7 mm | 24 | 22 |
| | 2 years 4 months-2 years 8 months | 4 months | 15.3 cm | 6 mm | 25 | 23 |
| | 2 years 8 months-3 years | 4 months | 16 cm | 7 mm | 26 | 24 |
| Series 3 | 3 years-3 years 4 months | 4 months | 16.7 cm | 7 mm | 27 | 25 |
| | 3 years 4 months-3 years 8 months | 4 months | 17.3 cm | 6 mm | 28 | 26 |
| | 3 years 8 months-4 years | 4 months | 18 cm | 7 mm | 29 | 27 |
| Series 4 | 4 years-4 years 10 months | 10 months | 18.6 cm | 6 mm | 30 | 28 |
| | 4 years 10 months-5 years 8 months | 10 months | 19.3 cm | 7 mm | 31 | 29 |
| | 5 years 8 months-6 years 6 months | 10 months | 19.9 cm | 6 mm | 32 | 30 |
| Series 5 | 6 years 6 months-7 years 4 months | 10 months | 20.6 cm | 7 mm | 33 | 31 |
| | 7 years 4 months-8 years 2 months | 10 months | 21.2 cm | 6 mm | 34 | 32 |
| | 8 years 2 months-9 years | 10 months | 21.9 cm | 7 mm | 35 | 33 |

Referring to FIGS. 15A & B, and Tables 1 and 2 provided above, it can be seen that the sole 16 expansion studies 102 indicate most of the growth occurred in the frontal toe area, and the width to length growth was not proportionate. This helped the inventor to group the sizes together in 102A and create different series of expandable shoes 01 of the present invention. Based on this study a custom foot scale to map the user's feet size, series as well as the actual length is also created to bring in use for the expandable shoes 01 of the present invention.

The unique structure and design of the sole 16 and the upper 18 hugs the user's feet and provide a thorough form fitting experience. The adaptability of the sole 16 and upper 18 of the expandable shoes 01 fits like a glove to any shape of feet inserted in them. Feet of size for example, 9, 9.5, 10 as well as every size in between these sizes can be catered to with a perfect fit by just one size of the expandable shoe 01 with its adaptive design. The expandable shoes adapt to each and every pair of feet, and not the other way around as in the case of conventional shoes.

Thus, referring to FIG. 16 the expandable shoe 01 of the invention replaces multiple pairs of conventional shoes with just one pair which does their job, as it expands. Most conventional shoes are predominantly fabricated from plastic and/plastic like materials. These petroleum-derived plastics (polyester, thermoplastic polyurethane (TPU), polyethylene terephthalate (PET) and ethylene-vinyl acetate (EVA) have a large carbon footprint. Moreover, only 5% of the world's end-of-life shoes are recycled, 95% end up in landfills. The plastic/petroleum derived substances used in most sneakers do not decompose and remain in the landfill for hundreds of years. For example, as shown in FIG. 16, a child during 1-9 years will need fifteen pairs of conventional shoes. Whereas the same child during their 1-9 years will need only five pairs of expandable shoes 01 of the present invention. This makes the invention sustainable and good for the environment and in turn reduces the number of shoes manufactured resulting in substantially reduced carbon foot print. The expandable shoe 01 and its packaging are made of environmentally friendly materials. It also saves users' money and resources on Earth. Thus, with the expandable shoes 01 of the present invention, less number of shoes will end up in landfills. The expandable shoe 01 being environment friendly is more sustainable, usable and value for money.

While the present invention focuses on an expandable shoe 01 for use by showing examples for children a baby, the principles of the present invention can also be incorporated into a slipper/sandal worn by children over 24 months of age or an adult. It will be appreciated that the term "children's slipper/sandals" can be substituted for the term "baby shoe" so that all of the unique features of the present invention are also incorporated into an expandable slipper for children.

The embodiments discussed above illustrate the various design features of the inventive concept. It is understood that the expandable shoe 01 of the present invention could be made in any number of styles in men's, women's or children's shoes. The shoes 01 can be laced or otherwise slipped on as illustrated. The inventive concept is not limited to the exemplary shoe 01 as illustrated but is provided only for purposes for defining the unique structure of the shoe 01 as it relates to the various components which enable it to expand from an unstretched relaxed version by two or more shoe sizes in terms of length, width and height as required to accommodate various sizes of feet.

The embodiments herein and the various features and advantageous details thereof are explained with reference to the non-limiting embodiments in the description. Descriptions of well-known components and processing techniques are omitted so as to not unnecessarily obscure the embodiments herein. The disclosure herein are intended merely to facilitate an understanding of ways in which the embodiments herein be practiced and to further enable those of skill in the art to practice the embodiments herein.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

LIST OF REFERENCE NUMERALS

| | |
|---|---|
| 01 | expandable shoe |
| 10 | sole grip/base line |
| 12 | sole inner surface |
| 14 | flap |
| 14A | flap before expansion |
| 14AA | expanded flap |
| 14B | flap cut locations |
| 14C | front flaps |
| 14D | side flaps 2 |
| 14E | back flaps |
| 16 | sole |
| 16A | sole topline |
| 16B | flexible V cut in sole |
| 18 | upper |
| 18A | stretchable collar |
| 18AA | collar |
| 18A1 | omni directional expansion |
| 18A2 | collar tongue |
| 18B | stretchable upper vamp |
| 18C | stretchable lower vamp |
| 18C1 | breathable ventilation holes |
| 18D | stretchable thick stiff knit pattern |
| 18E | lateral and base stability for foot |
| 18F | upper topline |
| 18G | upper strobel board |
| 18H | upper sock binding stitch |
| 19 | tongue |
| 19A | stretchable vamp |
| 19AA | vamp |
| 21 | elastic band |
| 21A | heel counter |
| 21B | stitching |
| 22 | pullstrap |
| 23 | outsole |
| 24 | sole cross section |
| 24A | sole cross section taper/taper |
| 24AA | cross section taper |
| 25 | ribs |
| 26 | insole |
| 27 | flexible V cut flap |
| 44 | natural foot shape last |
| 82 | wide toe box |
| 84 | zero drop straight sole |
| 86 | zero stack heel |
| 88 | last top |
| 90 | rounded profile |
| 92 | no edge filleted last/sole |
| 94A | ball girth cross section |
| 94B | instep cross section |
| 94C | heel cross section |

-continued

LIST OF REFERENCE NUMERALS

| | |
|---|---|
| 94D | human foot anatomy/natural foot shape/sole of a human foot |
| 102 | kids foot profiles from size 19-34 |
| 102A | foot measurement scale |
| 104A | no. of conventional shoes from age 1-9 years |
| 104B | no. of shoes with invention from age 1-9 years |
| 106 | air gaps in conventional shoes |
| 110 | Inverted Y cut |
| 110A | Inverted Y cut rounded vertices |
| 210 | straight cut |
| 210a | straight cut rounded vertices |
| 310 | star cut |
| 310A | star cut rounded vertices |
| 410 | wave cut |
| 410A | wave cut rounded vertices |
| 510 | nib cut |
| 510A | nib cut rounded vertices |
| 610 | slit cut |
| 610A | micro cut |
| 710 | elastic midsole/elastomer layer |
| 710A | elastic midsole stretched area |

The invention claimed is:

1. An expandable shoe (01) capable of growing with a wearer/user's feet comprising: an upper (18) together with an expanding sole (16) having an upper surface and a bottom surface which are capable of automatically adjusting and adapting comfortably to a wearer's feet resulting in increased comfort, usability and postponed obsolescence; wherein the sole (16) has a plurality of flaps (14) extending upwards from the bottom surface of the sole (16) around the circumference of the sole (16); wherein the shoe (01) further comprises: adjustment mechanisms including a plurality of cuts positioned at different locations in the sole (16) and having a pre-defined distance between the flaps (14); wherein said cuts effectively vary length and width of the shoe (01) and vary an interior size of the shoe (01) to provide a comfortable fit to the wearer/user; wherein said cuts comprise inverted 'Y' shaped cuts (110) are provided with rounded vertices (110A) and the rounded vertices (110A) are circular-shaped to avoid tearing and snagging of the flaps (14); and wherein said cuts optionally further comprise one or more further cuts selected from the group consisting of a 'V' shaped cut (27), a straight cut (210), a star cut (310), a wave cut (410), a nib cut (510), at least two micro cuts 610A, at least one slit (610) cut, a flexible V cut (16B) and a combination thereof and each of said optional further cuts is provided with or without rounded vertices (110A).

2. The expandable shoe (01) as claimed in claim 1, wherein the upper (18) comprises: a stretchable collar (18A) with omni expansion feature(s) (18A1) and having a collar tongue (18A2), an upper top line (18F), a stretchable upper vamp (18B) being inseparably stitched/connected to the stretchable collar (18A), a stretchable lower vamp (18C) being inseparably stitched/connected to the stretchable upper vamp (18B), a stretchable thick stiff knit pattern (18D) being inseparably stitched/connected to the stretchable lower vamp (18C); wherein the stretchable thick stiff knit pattern (18D) in turn being inseparably stitched/connected to a lateral and base stability for foot (18E); wherein the stretchable lower vamp (18C) provided with plurality of breathable ventilation holes (18C1) which helps the foot to perspire when the user is wearing the expandable shoe (01); wherein a pullstrap (22) is inseparably attached to the upper (18) on back side of the shoe (01); and wherein the upper (18) made of stretchy, mesh, elastic knitted material which is stuck inside the sole (16) being inseparable with the flaps (14) encompassing the upper (18).

3. The expandable shoe (01) as claimed in claim 1, wherein the sole (16) has a sole topline (16A) configured to run through the entire upper periphery of the sole (16) having equal width in that the sole topline (16A) runs at varying depth on left and right sides of the sole (16) in comparison to the front and back of the sole (16) and wherein the sole topline (16A) having a larger height on front and back of the sole (16) in comparison to the height on the left and right sides of the sole (16).

4. The expandable shoe (01) as claimed in claim 1, wherein the sole (16) has a uniform thickness with a tapered end (24A) towards the topline (16A) of the sole (16).

5. The expandable shoe (01) as claimed in claim 1, wherein the sole (16) is provided with structural strengthener in the form of ribs (25) on an inner and an outer side of the sole (16).

6. The expandable shoe (01) as claimed in claim 1, wherein the sole (16) is provided with an elastomer layer/stretchable elastic midsole (710) in midsole section thereof being pasted or sandwiched in between an inner lining of the sole (16) and the upper (18).

7. The expandable shoe (01) as claimed in claim 1, wherein the further cuts provided in the flaps (14) of the sole (16) comprise 'V' shaped cuts (27) with rounded vertices (110A).

8. The expandable shoe (01) as claimed in claim 1, wherein the further cuts provided in the flaps (14) of the sole (16) comprise at least two micro cuts 610A on the top line (16A) of the sole (16) and at least one slit (610) cut on the walls of the sole (16).

9. The expandable shoe (01) as claimed in claim 1, wherein the flaps (14) are positioned in front (14C), sides 14D and back (14E) of the sole (16).

10. The expandable shoe (01) as claimed in claim 1, wherein the sole (16) has a flexible V cut (16B) without any rounded vertices.

11. The expandable shoe (01) as claimed in claim 1, wherein the upper (18) comprises: a stretchable collar (18A), an elastic band (21), a tongue (19), a stretchable vamp (19A) each of them being inseparably stitched/connected in that the stretchable vamp (19A) is inseparably stitched/connected to a stretchable thick stiff knit pattern (18D) having a lateral and base stability for foot (18E).

12. The expandable shoe (01) as claimed in claim 11, wherein a pullstrap (22) is inseparably attached to the stretchable collar (18AP) on front side and another pullstrap (22) is attached to the upper (18) on the back side of the shoe (01).

13. The expandable shoe (01) as claimed in claim 11, wherein the stretchable vamp (19A) provided with plurality of breathable ventilation holes (18C1) which helps the foot to perspire when the user is wearing the expandable shoe (01).

14. The expandable shoe (01) as claimed in claim 1, wherein sole (16) provided with a base line with sole grips (10).

15. The expandable shoe (01) as claimed in claim 1, wherein the upper comprises lyocell or merino wool and the sole comprises rubber or bio-TPU for enduring the wear and tear from the prolonged usage as well as providing comfort and protection.

16. The expandable shoe (01) as claimed in claim 1, wherein the shoe (01) permits expansion for a foot in upward, lengthwise and sideways directions to provide a comfortable fit.

* * * * *